US006053642A

United States Patent [19]

Tanaka

[11] Patent Number: 6,053,642

[45] Date of Patent: Apr. 25, 2000

[54] PHOTOSENSITIVE-MATERIAL PROCESSING-SOLUTION REPLENISHING APPARATUS

[75] Inventor: Katsuhiko Tanaka, Kanagawa, Japan

[73] Assignee: Fuji Photo Film Co., Ltd., Kanagawa, Japan

[21] Appl. No.: 09/129,840

[22] Filed: Aug. 6, 1998

[30] Foreign Application Priority Data

| | | | |
|---|---|---|---|
| Aug. 29, 1997 | [JP] | Japan | 9-234129 |
| Aug. 29, 1997 | [JP] | Japan | 9-234130 |
| Aug. 29, 1997 | [JP] | Japan | 9-234132 |

[51] Int. Cl.[7] ..... G03D 3/02

[52] U.S. Cl. ..... 396/568; 396/578; 396/626

[58] Field of Search ..... 396/626, 578, 396/568; 430/30, 398–400

[56] References Cited

U.S. PATENT DOCUMENTS

| | | | |
|---|---|---|---|
| 5,025,279 | 6/1991 | Ellsworth | 396/626 |
| 5,307,107 | 4/1994 | Nozawa et al. | 396/626 |
| 5,797,059 | 8/1998 | Yoshizawa et al. | 396/626 |

*Primary Examiner*—D. Rutledge

*Attorney, Agent, or Firm*—Sughrue, Mion, Zinn, Macpeak & Seas, PLLC

[57] ABSTRACT

If processing agents and dilution water are supplied to replenishing tanks, the level of the resulting solutions may become higher than an upper limit level. This results in a different quantity processed of photosensitive material among the different replenishing tanks. A controlling device calculates the volume of the replenishing solution at a level higher than the upper limit level after the supply of cleaning water, and compares the calculated volume with the quantity of the replenishing solution when the replenishment is effected a prescribed number of times. The controlling device changes the driving time of a container cleaning pump to correspond to that ratio, and subsequently causes the actual number of replenishings to agree with a prescribed number of replenishings. In addition, a loading cover electromagnetic lock is controlled so that even if a cover opening switch is pressed, a loading section cover is not opened during the period from the beginning of the charging of the processing agents, through the cleaning of the containers, and until the end of the drying of the containers. Thus, it is possible to prevent the spilling and dripping of the processing agents when the containers are removed.

21 Claims, 14 Drawing Sheets

PHOTOSENSITIVE-MATERIAL PROCESSING-SOLUTION REPLENISHING APPARATUS

BACKGROUND OF THE INVENTION

1. Field of the Invention

The present invention relates to a photosensitive material processing solution replenishing apparatus used in a photosensitive material processing apparatus provided with a plurality of replenishing tanks for storing the replenishing solutions used to replenish a plurality of processing tanks, and which also comes equipped with a replenishing agent kit combining a plurality of types of replenishing agents in concentrated form.

2. Description of the Related Art

Hitherto, there have been proposed photosensitive material processing apparatuses of a type equipped with a replenishing agent kit combining a plurality of types of replenishing agents in concentrated form, the replenishing agents are supplied to replenishing tanks, and dilution water is subsequently supplied to the replenishing tanks to complete the replenishing solution.

With such a photosensitive material processing apparatus, a system is adopted wherein when the quantity of the photosensitive material processed reaches a preset quantity, all the replenishing tanks become empty, so that the timings for supplying each of the replenishing agents coincide with each other, thereby facilitating the replenishing operation.

However, there is a problem in that if an error, such as pump fatigue, slight clogging of the pipes, or the like, occurs in the dilution-water supplying means (e.g., the pump, pipes, solenoid valves, etc.) for replenishing dilution water to the replenishing tanks, each of the replenishing tanks does not become empty (i.e., fails to reach a predetermined value (a lower limit level) at the same time. Thus, a situation can occur in which although a certain replenishing tank is already empty, replenishers still remain in other replenishing tanks, with the result that replenishment cannot be effected properly.

In order to be able to replenish all the tanks together when such a situation has occurred, it is necessary to adjust the replenishing means (alter the rates of replenishment and discharge of replenishers) so that the timings of the replenishments will coincide, which imposes a burden on an operator (user).

Further, unless it is possible to ascertain whether the replenishing agents and dilution water have been supplied reliably to the replenishing tanks, the replenishment cannot be effected properly.

In addition, the replenishing agent kit adopts a system in which a plurality of containers filled with replenishers are collectively placed in, for instance, a cardboard box, and if this replenisher kit is loaded into the loading section of the apparatus, seals of the containers are opened by a seal opening means of the apparatus so as to charge (replenish) the replenishers into the replenishing tanks.

However, if the replenishing agent kit is removed during the refilling of the replenishers or immediately after the refilling, the spilling of the replenishers can occur, or the replenishers can drip from the containers immediately after the refilling, thereby contaminating the apparatus or the floor.

SUMMARY OF THE INVENTION

In view of the above-described circumstances, it is an object of the present invention to provide a photosensitive-material processing-solution replenishing apparatus which is capable of eliminating the operation of adjusting the replenishing means, of effecting proper replenishment over extended periods of time, and of preventing the spilling and dripping of the replenishing agents when the containers are removed.

In accordance with the first aspect of the present invention, there is provided a photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply the plurality of replenishing tanks with the plurality of types of replenishing agents, comprising: an upper limit sensor provided in each of the replenishing tanks capable of detecting whether the levels of the surfaces of the replenishing solutions have exceeded a predetermined upper limit level; replenishing means for replenishing the processing tanks with the replenishing solutions in the replenishing tanks; a dilution water tank for storing the dilution water; dilution-water supplying means for supplying the replenishing tanks with the dilution water; and controlling means for controlling the dilution-water supplying means, wherein the controlling means revises the subsequent quantities of dilution water supplied on the basis of the quantities of replenishing solution replenished to the processing tanks between the time the replenishing agents and the fixed quantities of diluted water were supplied to the replenishing tanks until the levels of the solutions drop to the upper limit level.

Next, a description will be given of the operation of the above-described photosensitive-material processing-solution replenishing apparatus in accordance with the first aspect of the present invention.

When a photosensitive material is processed in the processing tanks of a photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible.

When the levels of the replenishing solutions have reached the predetermined value (lower limit level) or less, the replenishing agents in concentrated form are collectively supplied to the respective replenishing tanks.

Subsequently, the controlling means controls the dilution-water supplying means to supply predetermined quantities of dilution water to the replenishing tanks to correspond with the predetermined replenishing agents.

Thus, by supplying the replenishing agents and predetermined quantities of dilution water to the replenishing tanks, replenishing solutions can be made up in the replenishing tanks, and the levels of the replenishing solutions can be made to exceed the upper limit level.

If there is no error in the dilution-water supplying means, and predetermined quantities of dilution water are supplied to the replenishing tanks, the volumes after replenishment of the portions of each solution between the upper limit levels in the replenishing tanks and the surfaces of the solutions which exceed the predetermined upper limit level should provide the same quantity of processing of the photosensitive material for each of the replenishing tanks.

Conventionally, if an error (such as pump fatigue, clogging of pipes, or the like) occurs in the dilution-water supplying means, the volumes after replenishment of the portions of each of the solutions between the upper limit levels in the replenishing tanks and the surfaces of the solutions which exceed the predetermined upper limit level fail to provide the same quantity of processing of the photosensitive material for each of the replenishing tanks. Thus, there is a problem in that when replenishment to the processing tanks is continued, all the replenishing solutions do not reach the lower limit level at the same time (i.e., the levels of the solutions in the replenishing tanks vary in the vicinity of the lower limit level), thereby making it impossible to effect collective supply of the replenishing agents.

On the other hand, in the present invention the controlling means revises the subsequent quantities of dilution water supplied based on the quantities of replenishing solutions replenished to the processing tanks between the time when the replenishing agents and the fixed quantities of dilution water were supplied to the replenishing tanks until the levels of the solutions drop to the upper limit levels (detected by the upper limit sensors). Therefore, the volumes after replenishment of the portions of each of the solutions between the upper limit levels in the replenishing tanks and the surfaces of the solutions which exceed the predetermined upper limit level can be made to provide the same quantity of processing of the photosensitive material for each of the replenishing tanks.

Accordingly, even if there is an error in the dilution-water supplying means, when replenishment is effected in predetermined quantities, all the replenishing solutions can be made to reach the lower limit level at the same time, so that the collective supply of the replenishing agents is constantly made possible.

In accordance with the second aspect of the present invention, there is provided a photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply the plurality of replenishing tanks with the plurality of types of replenishing agents from a processing agent kit loaded in the apparatus by opening the seals of the processing agent kit, comprising: replenishing means for replenishing the processing tanks with the replenishing solutions in the replenishing tanks; a dilution water tank for storing the dilution water; dilution-water supplying means for supplying the replenishing tanks with the dilution water; replenishing-agent supply detecting means having a lower limit sensor capable of detecting whether the levels of the surfaces of the replenishing solutions have exceeded a predetermined lower limit level, and once the levels of the surface of the solution have reached the lower limit levels or less, the seals of the processing agent kit are opened and the detecting means then detects that the supply of the replenishing agent has been completed when the levels of the surfaces of the solutions have risen above the lower limit levels; and dilution-water supply detecting means having an upper limit sensor capable of detecting whether the levels of the surfaces of the replenishing solutions have exceeded a predetermined upper limit level, and once the dilution water supply detecting means has detected that the supply of the replenishing agents has been completed, dilution water is supplied, and once the levels of the surfaces of the solutions have risen above the upper limit level, the dilution water supply detecting means detects that the supply of the dilution water has been completed.

Next, a description will be given of the operation of the above-described photosensitive-material processing-solution replenishing apparatus in accordance with the second aspect of the present invention.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks.

Whether the levels of the replenishing solutions have reached a predetermined value (lower limit level) can be detected by the lower limit sensor, and when the levels of the replenishing solutions have reached the predetermined value (lower limit level) or less, the replenishing agents in concentrated form are collectively supplied to each of the replenishing tanks.

Once the levels of the surface of the solution have reached the lower limit levels or less, the seals of the processing agent kit are opened. The detecting means then detects that the supply of the replenishing agent has been completed when the levels of the surfaces of the solutions have risen above the lower limit levels.

Once the dilution water supply detecting means has detected that the supply of the replenishing agents has been completed, the dilution water supply means supplies dilution water for a predetermined period of time, and once the levels of the surfaces of the replenishing solutions have risen above the upper limit level, the dilution water supply detecting means detects that the supply of the dilution water has been completed.

If the dilution water is supplied after completion of the supply of the replenishing agents, and the levels of the surfaces of the solutions exceed the upper limit level, the replenishing agents are diluted, and the formation of replenishing agents of predetermined concentrations is completed in the replenishing tanks.

Incidentally, if the levels of the surfaces of the solutions fail to rise above the lower limit levels after the seal opening, it follows that some malfunction has occurred in the supply of the replenishing agents, which malfunction can be detected by the replenishing-agent supply detecting means in the present invention.

In addition, if the levels of the surfaces of the solutions fail to rise above the lower limit levels after the dilution-water supplying means has operated for a predetermined time duration, it follows that some malfunction (e.g., fatigue of the dilution-water supply detecting means pump, clogging of pipes, or the like) has occurred in the supply of the dilution water, which malfunction can be detected by the replenishing-agent supply detecting means in the present invention.

Thus, in the present invention, it is possible to individually detect malfunctions in the supply of replenishing agents and the supply of dilution water.

In accordance with the third aspect of the present invention, there is provided a photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply the plurality of replenishing tanks with the plurality of types of replenishing agents from a processing agent kit loaded in the apparatus by opening the seals of the processing agent kit, comprising: replenishing means for replenishing the processing tanks with the replenishing solutions in the replenishing tanks; a dilution water tank for storing the dilution water; dilution-water supplying means for supplying the replenishing tanks with the dilution water; and replenishing-agent supply detecting means having a lower limit sensor capable of detecting whether the levels of the surfaces of the replenishing solutions have exceeded a predetermined lower limit level, and once the levels of the surface of the solution have reached the lower limit levels or less, the seals of the processing agent kit are opened and the detecting means then detects that the supply of the replenishing agent has been completed when the levels of the surfaces of the solutions have risen above the lower limit levels.

Next, a description will be given of the operation of the above-described photosensitive-material processing-solution replenishing apparatus in accordance with the third aspect of the present invention.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks.

Whether the levels of the replenishing solutions have reached a predetermined value (lower limit level) can be detected by the lower limit sensor, and when the levels of the replenishing solutions have reached the predetermined value (lower limit level) or less, the replenishing agents in concentrated form are collectively supplied to each of the replenishing tanks.

Once the levels of the surface of the solution have reached the lower limit levels or less, the seals of the processing agent kit are opened. The detecting means then detects that the supply of the replenishing agent has been completed when the levels of the surfaces of the solutions have risen above the lower limit levels.

If predetermined quantities of dilution water are supplied after the detection of completion of the supply of the replenishing agents, the replenishing agents are diluted, and the formation of replenishing agents of predetermined concentrations is completed in the replenishing tanks.

Incidentally, if the levels of the surfaces of the solutions fail to rise above the lower limit level after the seal opening, it follows that some malfunction has occurred in the supply of the replenishing agents, which malfunction can be detected by the replenishing-agent supply detecting means in the present invention.

In accordance with the fourth aspect of the present invention, there is provided a photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply the plurality of replenishing tanks with the plurality of types of replenishing agents from a processing agent kit loaded in the apparatus by opening the seals of the processing agent kit, comprising: replenishing means for replenishing the processing tanks with the replenishing solutions in the replenishing tanks; a dilution water tank for storing the dilution water; dilution-water supplying means for supplying the replenishing tanks with the dilution water; and dilution-water supply detecting means having an upper limit sensor capable of detecting whether the levels of the surfaces of the replenishing solutions have exceeded a predetermined upper limit level, and once the dilution water supply detecting means has detected that the supply of the replenishing agents has been completed, dilution water is supplied, and once the levels of the surfaces of the solutions have risen above the upper limit level, the dilution water supply detecting means detects that the supply of the dilution water has been completed.

Next, a description will be given of the operation of the above-described photosensitive-material processing-solution replenishing apparatus in accordance with the fourth aspect of the present invention.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks.

Whether the levels of the replenishing solutions have reached a predetermined value (lower limit level) can be detected by the lower limit sensor, and when the levels of the replenishing solutions have reached the predetermined value (lower limit level) or less, the replenishing agents in concentrated form are collectively supplied to each of the replenishing tanks.

Once the levels of the surfaces of the solutions have reached the lower limit levels or less, the seals of the processing agent kit are opened. The levels of the surfaces of the solutions then rise above the lower limit level.

Subsequently, the dilution-water supplying means is operated for a predetermined time duration so as to supply predetermined quantities of dilution water, and if it is detected that the levels of the surfaces of the solutions have risen above the upper limit level, the dilution-water supply detecting means detects the completion of supply of the dilution water.

If the dilution water is supplied after completion of the supply of the replenishing agents, and the levels of the surfaces of the solutions exceed the upper limit level, the replenishing agents are diluted, and the formation of replenishing agents of predetermined concentrations is completed in the replenishing tanks.

Incidentally, if the levels of the surfaces of the solutions fail to rise above the upper limit level after the dilution-water supplying means is operated for a predetermined time duration, it follows that some malfunction (e.g., fatigue in the dilution-water supply detecting means pump, clogging of pipes, or the like) has occurred in the supply of the dilution water, which malfunction can be detected by the replenishing-agent supply detecting means in the present invention.

In accordance with the fifth aspect of the present invention, there is provided a photosensitive-material processing-solution replenishing apparatus for collectively supplying a plurality of replenishing tanks with a plurality of types of replenishing solutions, comprising: photosensitive-material processing-quantity detecting means for detecting a quantity processed of a photosensitive material; the plurality of replenishing tanks provided to correspond with a plurality of processing tanks for processing the photosensitive material in processing solutions, and for storing the plurality of types of replenishing solutions; replenishing solution-quantity detecting means provided in each of the replenishing tanks for detecting whether the residual quantity of the replenishing solution is at a predetermined value or less; replenishing means for replenishing the processing tanks with the replenishing solutions in the replenishing tanks; and controlling means for controlling the replenishing means so that the processing tanks are replenished with the replenishing solutions in a quantity corresponding to a predetermined quantity processed of the photosensitive material, wherein, if the residual quantity of a specific replenishing solution has not reached the predetermined value or less when a preset quantity of the photosensitive material has been processed, the controlling means forcibly causes the replenishment to be effected so that the residual quantity of the specific replenishing solution reaches the predetermined value or less.

Next, a description will be given of the operation of the above-described photosensitive-material processing-solution replenishing apparatus in accordance with the fifth aspect of the present invention.

A plurality of types of replenishing solutions are collectively supplied to the plurality of replenishing tanks of the photosensitive material processing apparatus.

If the photosensitive material is processed in the processing tanks of the photosensitive material processing apparatus, the processing solutions gradually deteriorate as the photosensitive material is processed. For this reason, when the quantity of the photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible. Incidentally, whether the residual quantities of the replenishing solutions in the replenishing tanks are at a predetermined value or less can be detected by the replenishing solution-quantity detecting means, whereby the timings of replenishment of the replenishing solutions can be determined.

In addition, the residual quantities of replenishing solutions can be made to reach a preset value or less when the quantity of photosensitive material processed reaches a preset quantity, with the result that the timing at which the processing tanks are replenished with the replenishing solutions can be made to coincide with the processing of a preset quantity of photosensitive material by corresponding the processing of a preset quantity of photosensitive material with the quantities of replenishing solutions replenished to the processing tanks. Accordingly, a preset quantity of photosensitive material can be reliably processed by the processing solutions in processing tanks which have been activated by being replenished with replenishing solutions.

If an error occurs in the replenishing means (e.g., pump fatigue, clogging of pipes, etc.), the residual quantity of a specific replenishing solution may fail to reach the predetermined value when the preset quantity of the photosensitive material has been processed.

In such a case, the processing tank is forcibly replenished with the specific replenishing solution, and the residual quantity of the specific replenishing solution is forcibly set to not more than the predetermined value of the replenishing tank.

Therefore, even if an error has occurred in the replenishing means, the collective supply of the replenishing solutions becomes possible.

It should be noted that to attain the collective supply of the replenishing solutions without effecting the above-described forcible replenishment, it becomes necessary for the operator to calibrate the discharge rate of the replenishing means and the like, so that the burden imposed on the operator increases.

In accordance with the sixth aspect of the present invention, there is provided a photosensitive-material processing-solution replenishing apparatus for collectively supplying a plurality of replenishing tanks with a plurality of types of replenishing solutions, comprising: photosensitive-material processing-quantity detecting means for detecting a quantity processed of a photosensitive material; the plurality of replenishing tanks provided to correspond with a plurality of processing tanks for processing the photosensitive material in processing solutions, and for storing the plurality of types of replenishing solutions; replenishing solution-quantity detecting means provided in each of the replenishing tanks to detect whether the residual quantity of the replenishing solution is at a predetermined value or less; replenishing means for replenishing the processing tanks with the replenishing solutions in the replenishing tanks; controlling means for controlling the replenishing means so as to replenish the processing tanks with the replenishing solutions in a quantity corresponding to a predetermined quantity processed of the photosensitive material; and warning means which is controlled by the controlling means, wherein, if the residual quantity of a specific replenishing solution has not reached the predetermined value or less when a preset quantity of the photosensitive material has been processed, the controlling means forcibly causes the replenishment to be effected so that the residual quantity of the specific replenishing solution reaches the predetermined value or less, the controlling means calibrates a replenishment quantity on the basis of the duration or number of replenishings until the predetermined value or less is reached, so that the residual quantity of the specific replenishing solution reaches the predetermined value or less when the preset quantity of the photosensitive material has been processed, and the controlling means causes the warning means to issue a warning if the calibrated value is outside a preset range.

Next, a description will be given of the operation of the above-described photosensitive-material processing-solution replenishing apparatus in accordance with the sixth aspect of the present invention.

A plurality of types of replenishing solutions are collectively supplied to the plurality of replenishing tanks of the photosensitive material processing apparatus.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible. Incidentally, whether the remaining quantities of the replenishing solutions in the replenishing tanks are at a predetermined value or less can be detected by the replenishing solution-quantity detecting means, whereby the timings of replenishment of the replenishing solutions can be determined.

In addition, the residual quantities of replenishing solutions can be made to reach a preset value or less when the quantity of photosensitive material processed reaches a preset quantity, with the result that the timing at which the processing tanks are replenished with the replenishing solutions can be made to coincide with the processing of a preset quantity of photosensitive material by corresponding the processing of a preset quantity of photosensitive material with the quantities of replenishing solutions replenished to the processing tanks. Accordingly, a preset quantity of photosensitive material can be reliably processed by the processing solutions in processing tanks which have been activated by being replenished with replenishing solutions.

If an error occurs in the replenishing means (e.g., pump fatigue, clogging of pipes, etc.), the residual quantity of a specific replenishing solution may fail to reach the predetermined value when the preset quantity of the photosensitive material has been processed.

In such a case, the processing tank is forcibly replenished with the specific replenishing solution, and the residual quantity of the specific replenishing solution is forcibly set to not more than the predetermined value of the replenishing tank.

The replenishment quantity is calibrated on the basis of the length or number of replenishings until the predetermined value or less is reached, so that the residual quantity of the specific replenishing solution reaches the predetermined value or less when the preset quantity of photosensitive material has been processed. Subsequent replenishments are made according to the calibrated replenishment quantities. Accordingly, subsequently, the processing tanks can be replenished with appropriate quantities of replenishing solutions.

Thereafter, the timing of the supply of the replenishing solution can be made to coincide with the processing of a preset quantity of photosensitive material, and a preset quantity of photosensitive material can be reliably processed by the processing solutions in processing tanks which have been activated by the supply of replenishing solutions.

Thus, even if an error has occurred in the replenishing means, collective supply of the replenishing solutions becomes possible.

It should be noted that to attain the collective supply of the replenishing solutions without effecting the above-described forcible replenishment, it becomes necessary for the operator to calibrate the discharge rate of the replenishing means and the like, so that the burden imposed on the operator increases.

In addition, if the calibrated value is outside a predetermined value set in advance, it means that the amount of replenishing solution supplied is substantially insufficient for the amount of photosensitive material processed. Hence, in such a case, a warning is issued by the warning means, making it possible to notify the operator of the abnormality of the apparatus.

In accordance with the seventh aspect of the present invention, there is provided a photosensitive-material processing-solution replenishing apparatus for collectively supplying a plurality of replenishing tanks with a plurality of types of replenishing solutions, comprising: photosensitive-material processing-quantity detecting means for detecting a quantity processed of a photosensitive material; the plurality of replenishing tanks provided to correspond with a plurality of processing tanks for processing the photosensitive material with processing solutions, and for storing the plurality of types of replenishing solutions; replenishing solution-quantity detecting means provided in each of the replenishing tanks to detect whether the residual quantity of the replenishing solution is at a predetermined value or less; replenishing means for replenishing the processing tanks with the replenishing solutions in the replenishing tanks; and controlling means for controlling the replenishing means so as to replenish the processing tanks with the replenishing solutions in a quantity corresponding to a predetermined quantity processed of the photosensitive material, wherein, if the residual quantity of a specific replenishing solution has reached the predetermined value or less before a preset quantity of the photosensitive material has been processed, the controlling means interrupts the replenishment from the specific replenishing solution until the preset quantity of the photosensitive material has been processed.

Next, a description will be given of the operation of the above-described photosensitive-material processing-solution replenishing apparatus in accordance with the seventh aspect of the present invention.

A plurality of types of replenishing solutions are collectively supplied to the plurality of replenishing tanks of the photosensitive material processing apparatus.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible. Incidentally, whether the residual quantities of the replenishing solutions in the replenishing tanks are at the predetermined value or less can be detected by the replenishing solution-quantity detecting means, whereby the timings of replenishment of the replenishing solutions can be determined.

In addition, the residual quantities of replenishing solutions can be made to reach a preset value or less when the quantity of photosensitive material processed reaches a preset quantity, with the result that the timing at which the processing tanks are replenished with the replenishing solutions can be made to coincide with the processing of a preset quantity of photosensitive material by corresponding the processing of a preset quantity of photosensitive material with the quantities of replenishing solutions replenished to the processing tanks. Accordingly, a preset quantity of photosensitive material can be reliably processed by the processing solutions in processing tanks which have been activated by being replenished with replenishing solutions.

If an error occurs in the replenishing means (e.g., pump fatigue, clogging of pipes, etc.), the residual quantity of the specific replenishing solution may reach the predetermined value or less before the preset quantity of the photosensitive material has been processed.

In such a case, the replenishment of the specific replenishing solution is interrupted until the preset quantity of the photosensitive material has been processed.

As a result, even if an error has occurred in the replenishing means, the collective supply of the replenishing solutions becomes possible.

It should be noted that to attain the collective supply of the replenishing solutions without interrupting the replenishment of the specific replenishing solution, it becomes necessary for the operator to calibrate the discharge rate of the replenishing means and the like, so that the burden imposed on the operator increases.

In accordance with the eighth aspect of the present invention, there is provided a photosensitive-material processing-solution replenishing apparatus for collectively supplying a plurality of replenishing tanks with a plurality of types of replenishing solutions, comprising: photosensitive-material processing-quantity detecting means for detecting a quantity processed of a photosensitive material; the plurality of replenishing tanks provided to correspond with a plurality of processing tanks for processing the photosensitive material with processing solutions, and for storing the plurality of types of replenishing solutions; replenishing solution-quantity detecting means provided in each of the replenishing tanks to detect whether the residual quantity of the replenishing solution is at a predetermined value or less; replenishing means for replenishing the processing tanks with the replenishing solutions in the replenishing tanks to correspond with a predetermined quantity of processed photosensitive material; controlling means for controlling the replenishing means so as to replenish the processing tanks with the replenishing solutions in a quantity corresponding to the predetermined quantity processed of the photosensitive material; and warning means which is controlled by the controlling means, wherein, if the residual quantity of a specific replenishing solution has reached the predetermined value or less before a preset quantity of the photosensitive material has been processed, the controlling means calculates the quantity of replenishment on the basis of the quantity of photosensitive material processed between the point when the solution was replenished until the point when the level of the solution reached the preset value or less, so that on the basis of the quantity of photosensitive material processed before the level of the replenishing solution reaches the preset value or less, the specific replenishing solution reaches the preset value or less at the time when the predetermined quantity of photosensitive material has been processed, and the controlling means causes the warning means to issue a warning if the calibrated value is outside a preset range.

Next, a description will be given of the operation of the above-described photosensitive-material processing-solution replenishing apparatus in accordance with the eighth aspect of the present invention.

A plurality of types of replenishing solutions are collectively supplied to the plurality of replenishing tanks of the photosensitive material processing apparatus.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible. Incidentally, whether the remaining quantities of the replenishing solutions in the replenishing tanks are at a predetermined value or less can be detected by the replenishing solution-quantity detecting means, whereby the timings of replenishment of the replenishing solutions can be determined.

In addition, the residual quantities of replenishing solutions can be made to reach a preset value or less when the quantity of photosensitive material processed reaches a preset quantity, with the result that the timing at which the processing tanks are replenished with the replenishing solutions can be made to coincide with the processing of a preset quantity of photosensitive material by corresponding the processing of a preset quantity of photosensitive material with the quantities of replenishing solutions replenished to the processing tanks. Accordingly, a preset quantity of photosensitive material can be reliably processed by the processing solutions in processing tanks which have been activated by being replenished with replenishing solutions.

If an error occurs in the replenishing means (e.g., pump fatigue, clogging of pipes, etc.), a specific replenishing solution may reach the predetermined value or less before the preset quantity of the photosensitive material has been processed.

In a case such as this, the quantity of replenishment is calibrated on the basis of the quantity of photosensitive material processed between the point when the solution was replenished until the point when the level of the solution reached the preset value or less, so that on the basis of the quantity of photosensitive material processed before the level of the replenishing solution reaches the preset value or less, the specific replenishing solution reaches the preset value or less at the time when the predetermined quantity of photosensitive material has been processed. Subsequent replenishments are made according to the calibrated replenishment quantities. Accordingly, subsequently, the processing tanks can be replenished with appropriate quantities of replenishing solutions.

Thereafter, the timing of the supply of the replenishing solutions can be made to coincide with the processing of a preset quantity of photosensitive material, and a preset quantity of photosensitive material can be reliably processed by the processing solutions in processing tanks which have been activated by the supply of replenishing solutions.

Thus, even if an error has occurred in the replenishing means, the collective supply of the replenishing solutions becomes possible.

It should be noted that to attain the collective supply of the replenishing solutions without effecting the above-described forcible replenishment, it is necessary for the operator to calibrate the discharge rate of the replenishing means and the like, so that the burden imposed on the operator increases.

In addition, if the calibrated value is outside a predetermined value set in advance, it means that the quantity of replenishing solution supplied is substantially insufficient for the quantity of photosensitive material processed. Hence, in such a case, a warning is issued by the warning means, making it possible to notify the operator of the abnormality of the apparatus.

In accordance with the ninth aspect of the present invention, there is provided a photosensitive-material processing-solution replenishing apparatus for collectively supplying a plurality of replenishing tanks with a plurality of types of replenishing solutions, comprising: photosensitive-material processing-quantity detecting means for detecting a quantity processed of a photosensitive material; the plurality of replenishing tanks provided to correspond with a plurality of processing tanks for processing the photosensitive material with processing solutions, and for storing the plurality of types of replenishing solutions; replenishing solution-quantity detecting means provided in each of the replenishing tanks to detect whether the residual quantity of the replenishing solution is at a predetermined value or less; replenishing means for replenishing the processing tanks with the replenishing solutions in the replenishing tanks; and controlling means for controlling the replenishing means so as to replenish the processing tanks with the replenishing solutions in a quantity corresponding to a predetermined quantity processed of the photosensitive material, wherein, if the residual quantities of the other replenishing solutions are greater than the predetermined value when the residual quantity of a specific replenishing solution has reached the predetermined value or less, the controlling means effects any one of or an arbitrary combination of two or more of the following four processes: (i) a process whereby the replenishment from the other replenishing solutions is effected forcibly until the residual quantities of the other replenishing solutions reach the predetermined value or less; (ii) a process whereby the replenishment from the specific replenishing solution is interrupted until the residual quantities of the other replenishing solutions reach the predetermined value; (iii) a process whereby the replenishment from the other replenishing solutions is effected forcibly until the residual quantities of the other replenishing solutions reach the predetermined value or less, and for revising the quantities replenished from the other replenishing solutions per unit quantity processed of the photosensitive material on the basis of the time required for the forcible replenishment or the number of the forcible replenishments; and (iv) a process whereby the replenishment from the other replenishing solutions is effected forcibly until the residual quantities of the other replenishing solutions reach the predetermined value or less, and for revising the quantity replenished from the specific replenishing solution per unit quantity processed of the photosensitive material on the basis of the time required for the forcible replenishment or the number of the forcible replenishments.

Next, a description will be given of the operation of the above-described photosensitive-material processing-solution replenishing apparatus in accordance with the ninth aspect of the present invention.

A plurality of types of replenishing solutions are collectively supplied to the plurality of replenishing tanks of the photosensitive material processing apparatus.

If the photosensitive material is processed in the processing tanks of the photosensitive material processing apparatus, the processing solutions gradually deteriorate as the photosensitive material is processed. For this reason, when the quantity of photosensitive material processed reaches a predetermined quantity, the processing tanks are replenished with a quantity of replenishing solution from the replenishing tanks by the replenishing means on the basis of the above predetermined quantity of photosensitive material processed. By this the processing solution is activated. It should be noted that, specifically, the replenishing means are made up of pumps, pipes, and the like, and may comprise solenoid valves and the like.

The levels of the replenishing solutions in each of the replenishing tanks can be made to reach a predetermined set value or less (the lower limit level) at the same time by corresponding the volumes of all the processing and replenishing tanks with the length of time and number of times of the replenishment of the processing tanks. As a result, the collective supply of the replenishing solutions becomes possible. Incidentally, whether the remaining quantities of the replenishing solutions in the replenishing tanks are at a predetermined value or less can be detected by the replenishing solution-quantity detecting means, whereby the timings of replenishment of the replenishing solutions can be determined.

In addition, the residual quantities of replenishing solutions can be made to reach a preset value or less when the quantity of photosensitive material processed reaches a preset quantity, with the result that the timing at which the processing tanks are replenished with the replenishing solutions can be made to coincide with the processing of a preset quantity of photosensitive material by corresponding the processing of a preset quantity of photosensitive material with the quantities of replenishing solutions replenished to the processing tanks. Accordingly, a preset quantity of photosensitive material can be reliably processed by the processing solutions in processing tanks which have been activated by being replenished with replenishing solutions.

If an error, such as pump fatigue and clogging of pipes, has occurred, there are cases where the residual quantities of the other replenishing solutions are greater than the predetermined value when the residual quantity of a specific replenishing solution has reached the predetermined value or less. In this case, the controlling means effects any one of or an arbitrary combination of two or more of the following four processes:

(i) a process whereby the replenishment from the other replenishing solutions is effected forcibly until the residual quantities of the other replenishing solutions reach the predetermined value or less;

(ii) a process whereby the replenishment from the specific replenishing solution is interrupted until the residual quantities of the other replenishing solutions reach the predetermined value;

(iii) a process whereby the replenishment from the other replenishing solutions is effected forcibly until the residual quantities of the other replenishing solutions reach the predetermined value or less, and for revising the quantities replenished from the other replenishing solutions per unit quantity processed of the photosensitive material on the basis of the time required for the forcible replenishment or the number of the forcible replenishments; and (iv) a process whereby the replenishment from the other replenishing solutions is effected forcibly until the residual quantities of the other replenishing solutions reach the predetermined value or less, and for revising the quantity replenished from the specific replenishing solution per unit quantity processed of the photosensitive material on the basis of the time required for the forcible replenishment or the number of the forcible replenishments.

If any one of the above processes (i) to (iv) is effected, even if an error has occurred in the replenishing means, the collective supply of the replenishing solutions becomes possible.

It should be noted that to attain the collective supply of the replenishing solutions without effecting the above-described forcible replenishment, it becomes necessary for the operator to calibrate the discharge rate of the replenishing means and the like, so that the burden imposed on the operator increases.

In addition, in the processing in (i) to (iv) above, subsequently, the replenishing solutions are replenished by the calibrated replenishment quantities, and subsequently the processing tanks can be replenished with appropriate quantities of replenishing solutions.

In accordance with the 10th aspect of the present invention, the photosensitive-material processing-solution replenishing apparatus according to the first aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 10th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 11th aspect of the present invention, the photosensitive-material processing-solution replenishing apparatus according to the second aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 11th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 12th aspect of the present invention, the photosensitive-material processing-solution replenishing apparatus according to the third aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 12th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 13th aspect of the present invention, the photosensitive-material processing-solution replenishing apparatus according to the fourth aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 13th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 14th aspect of the present invention, the photosensitive-material processing-solution replenishing apparatus according to the fifth aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 14th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 15th aspect of the present invention, the photosensitive-material processing-solution replenishing apparatus according to the sixth aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 15th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 16th aspect of the present invention, the photosensitive-material processing-solution replenishing apparatus according to the seventh aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 16th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 17th aspect of the present invention, the photosensitive-material processing-solution replenishing apparatus according to the eighth aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 17th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 18th aspect of the present invention, the photosensitive-material processing-solution replenishing apparatus according to the ninth aspect of the invention further comprises: a loading section for loading containers containing the replenishing agents; and at least one of warning means for issuing a warning prohibiting the movement of the containers during the replenishment of the replenishing agents or until the lapse of a predetermined time after the completion of the replenishment, and movement prohibiting means for prohibiting the movement of the containers during the replenishment of the replenishing agents or until the lapse of a predetermined time after the completion of the replenishment.

Next, a description will be given of the operation of the above-described photosensitive-material processing-solution replenishing apparatus in accordance with the 18th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

In accordance with the 19th aspect of the present invention, there is provided a photosensitive-material processing-solution replenishing apparatus having a replenishing tank for storing a replenishing agent with which a processing tank for processing a photosensitive material with a processing solution is replenished, wherein the replenishing agent contained in a container loaded into said apparatus is allowed to flow out by opening a seal of the container, thereby supplying said replenishing tank with the replenishing agent, comprising: a loading section for loading said container; and at least one of warning means for issuing a warning prohibiting the movement of said container during the replenishment of the replenishing agent or until the lapse of a predetermined time after the completion of the replenishment, and movement prohibiting means for prohibiting the movement of said container during the replenishment of the replenishing agent or until the lapse of a predetermined time after the completion of the replenishment.

Next, a description will be given of the operation of the above-described photosensitive-material processing-solution replenishing apparatus in accordance with the 19th aspect of the present invention.

When the replenishing agents are supplied to the replenishing tanks, the containers are loaded into the loading section, and their seals are opened.

The warning means issues a warning prohibiting the movement of the containers during the replenishment of the replenishing agents or until the lapse of a predetermined time after the completion of the replenishment, so that a judgment can be made that the containers cannot be taken out. Meanwhile, the movement prohibiting means prohibits the movement of the containers during the replenishment of the replenishing agents or until the lapse of a predetermined time after the completion of the replenishment, so that the removal of the containers is made impossible.

For this reason, it is possible to prevent the spilling and dripping of the replenishing agents when the containers are removed.

It should be noted that the replenishing agents may be a liquid or a solid (powder).

The predetermined time referred to herein means the time until the dripping of the replenishing agent from the container stops. If the replenishing agents are a liquid, the predetermined time is preferably the time required for the container to dry completely.

As for the warning means and the movement prohibiting means, it suffices if at least one of them is provided, and both of them may be provided.

DESCRIPTION OF THE PREFERRED EMBODIMENTS

Figure 1:
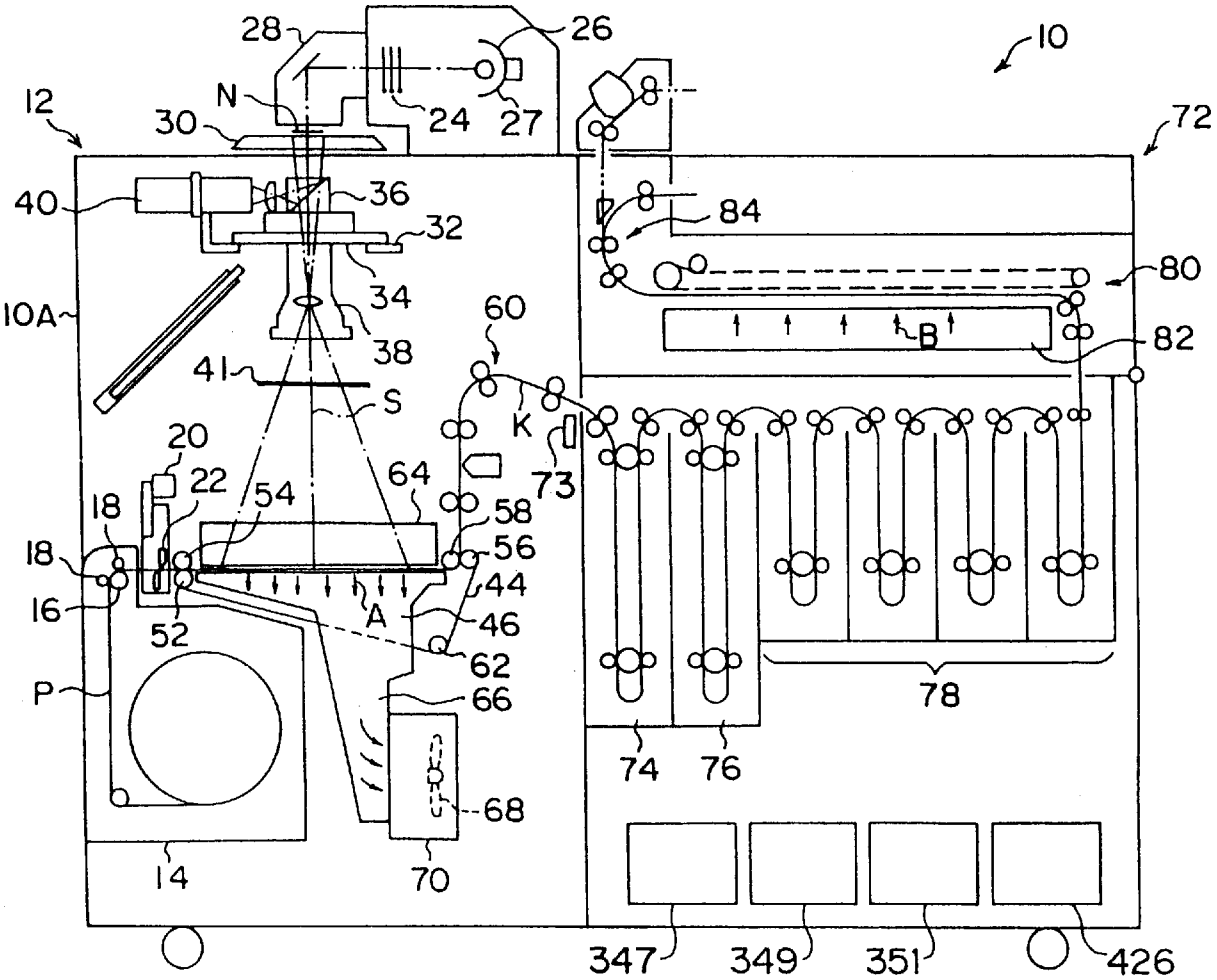
FIG. 1 is a schematic structural diagram illustrating a printer processor in which an embodiment of the present invention is applied.
Figure 2:
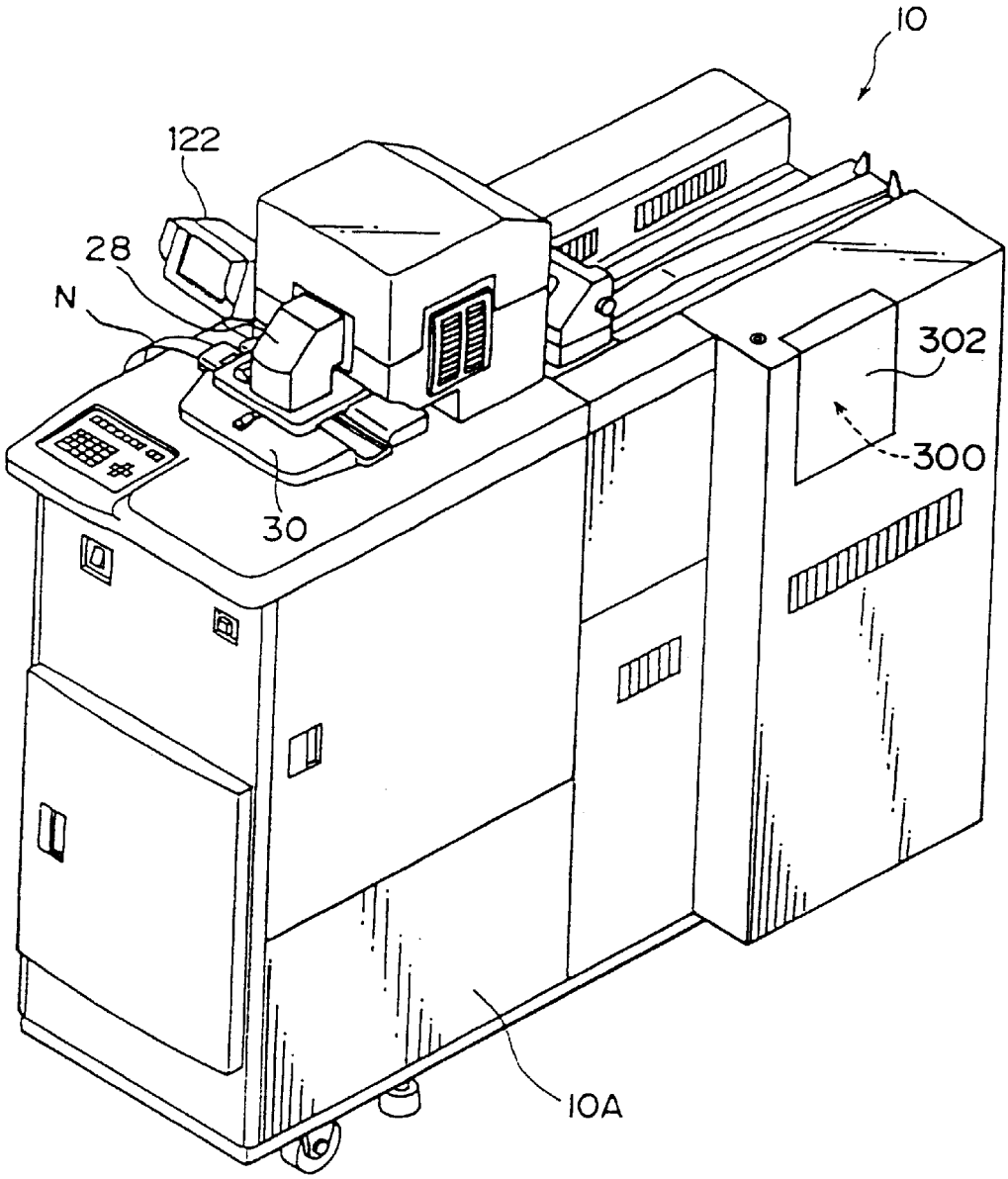
FIG. 2 is a perspective view illustrating the printer processor in which an embodiment of the present invention is applied.

FIG. 1 schematically shows a printer processor 10 in which the present invention is applied, and FIG. 2 shows a perspective view of the printer processor 10. A photographic printing section 12 constituting the printer section of this printer processor 10 has a structure in which a paper magazine 14 with photographic printing paper P accommodated therein can be loaded into the photographic printing section 12.

A drive roller 16, around which the leading end of the printing paper P is wound, is rotatably supported on the upper left side of the paper magazine 14 in FIG. 1. The drive roller 16 rotates by receiving a driving force of an unillustrated motor in the photographic printing section 12. A pair of nip rollers 18 are disposed at a position opposite the drive roller 16 with the photographic paper P placed therebetween. For this reason, the drive roller 16 nips the photographic paper P between itself and the nip rollers 18, and feeds the photographic paper P into the photographic printing section 12.

On the other hand, a cutter 22, which is comprised of a pair of upper and lower blades moved by a motor 20, is installed in the photographic printing section 12, and the photographic paper P fed out from the paper magazine 14 is cut instantly by the cutter 22.

A supporting base 46 whose upper surface is formed in such a manner as to extend horizontally (in the left-and-right direction in FIG. 1) is disposed on the downstream side in the traveling direction of the photographic paper P, i.e., on the right-hand side of the cutter 22 in FIG. 1. A winding roller 52, around which an endless belt 44 is wound, is disposed horizontally (in a direction perpendicular to the plane of the drawing in FIG. 1) between the supporting base 46 and the cutter 22. In addition, a nip roller 54 for nipping the endless belt 44 between itself and the winding roller 52 is disposed on the upper side of the winding roller 52.

A guide roller 56, around which the endless belt 44 is wound, is located downstream of the supporting base 46 in the traveling direction of the photographic paper P. A pressing roller 58 whose lower surface portion is at substantially the same height as the upper surface portion of the winding roller 52 is disposed at a position adjacent to the guide roller 56. This pressing roller 58 presses the outer periphery of the endless belt 44.

That is, as shown in FIG. 1, this portion of the endless belt 44 is formed in an S-shape. Further, the endless belt 44 is wound around a tension roller 62 on the lower side of the guide roller 56, thereby forming a path of movement which is shaped in the form of an inverted triangle. The guide roller 56 is rotatively driven by the driving force of an unillustrated motor, and rotates the endless belt 44 clockwise as viewed in FIG. 1.

A multiplicity of small holes (not shown) are formed in the endless belt 44 over the entire area thereof. In correspondence with the small holes in the endless belt 44, a multiplicity of holes (not shown) are formed in an upper surface of the supporting base 46 where a portion of the endless belt 44 is placed. The interior of the supporting base 46 is formed in a hollow shape, and a pair of communicating ducts 66, (only one is shown in FIG. 1) formed corresponding to both transverse edges of the endless belt 44, are connected to the supporting base 46. These communicating ducts 66 go around the portion of the endless belt 44 passing below the supporting base 46, continue past the lower side of the endless belt 44, and are connected to a fan box 70 provided with a suction fan 68.

On the other hand, as shown in FIG. 1, an easel device 64 is provided over the endless belt 44 moving on the supporting base 46, so as to cover the periphery of the photographic paper P by unillustrated movable pieces provided in the easel device 64 when an image requiring a border is printed onto the photographic paper P.

Further, a diffusing box 28 for diffusing light is disposed at a position immediately above the easel device 64 and outside a casing 10A constituting the outer frame of the printer processor 10. Arranged next to and on the right side of the diffusion box 28 is a CC filter 24 composed of a set of C, M, and Y filters which are respectively movable so as to make variable the amount of filtering inserted into the optical path. Accordingly, after a light beam emitted from a light source 26 located adjacent to the CC filter 24 is transmitted through the CC filter 24, the light beam is reflected downward while being diffused by the diffusing box 28. The light beam is then transmitted through a negative film N on a negative carrier 30 placed on the upper surface of the casing 10A.

A supporting plate 34 is supported by a pair of guide rails 32 disposed in the photographic printing section 12, in such a manner as to be movable in a horizontal direction (in a direction perpendicular to the plane of the drawing in FIG. 1). A prism 36 and a zoom lens 38 are mounted on the supporting plate 34 in such a manner as to be aligned with an optical axis S of the light beam.

Accordingly, the light beam, after being transmitted through the negative film N and converted into an exposing light beam, is transmitted through the prism 36, and then passes through the zoom lens 38 which is capable of changing the magnification for enlargement. The light beam then forms the image on the negative film N on the photographic paper P located below the easel device 64.

A density measuring instrument 40, which is comprised of, for example, a color filter and an optical sensor such as a CCD to measure the density of the negative film N, is disposed in the photographic printing section 12. Light beams reflected in a horizontal direction by the prism 36 are directed into the density measuring instrument 40. The density measuring instrument 40 is electrically connected to an unillustrated controller, and is used to set an exposure correction value during print-exposure on the basis of data measured by the density measuring instrument 40 and data keyed in by an operator.

Furthermore, a black shutter 41 is provided in the optical path between the zoom lens 38 and the easel device 64. The black shutter 41 effects print-exposure for a predetermined time duration by using the light whose color and intensity have been adjusted by the CC filter 24 and which has been transmitted through the negative film N.

Since the photographic printing section 12 is provided with the above-described structure, after the photographic paper P fed out from the paper magazine 14 is cut to a predetermined length by the cutter 22, the photographic paper P is placed on the endless belt 44, and is transported to the image printing position which is a position on the optical axis S of the exposing light beam. As the exposing light beam from the light source 26 reaches the photographic paper P through the prism 36, the zoom lens 38, and the like, and the black shutter 42 is opened for a predetermined time duration, the image recorded on the negative film N is exposed onto the photographic paper P, and the portion where the image is exposed becomes the image portion.

At this time, the air inside the supporting base 46 is drawn in the transverse direction of the endless belt 44 from inside the loop of the endless belt 44 through the communicating ducts 66, and is suctioned by the suction fan 68 to be blown to the outside. Consequently, the interior of the supporting base 46 is held under negative pressure. This negative pressure is transmitted to the photographic paper P on the endless belt 44 through the holes in the supporting base 46 and the small holes in the endless belt 44, so that the photographic paper P is suctioned onto the endless belt 44, as shown by arrows A. For this reason, since the photographic paper P is not only carried on the endless belt 44, but also suctioned toward the endless belt 44, the photographic paper P is transported reliably by the endless belt 44, and is placed in a horizontal state at the image printing position.

Further, the photographic paper P on which the print-exposure of the image has been completed is nipped by the guide roller 56 and the pressing roller 58, and is fed out in a vertical direction after its traveling direction is changed from the horizontal direction to the vertical direction. Subsequently, as indicated by the path K showing the traveling direction of the photographic paper P, the photographic paper P is transported to a processor section 72 for effecting various processings, including development, bleaching, fixing, washing, and drying, via a transport passage 60 formed by a plurality of pairs of rollers.

This completes the print-exposure for one image frame portion of the negative film N. As this process is repeated, the photographic paper P after being subjected to print exposure processing is transported consecutively to the processor section 72.

A developing solution is stored in a developing tank 74 inside the processor section 72, and the photographic paper P is immersed in the developing solution so as to effect development processing. The printing paper P after being subjected to development processing is transported to a bleaching tank 76 located adjacent to the developing tank 74. A bleaching solution is stored in the bleaching tank 76, and the photographic paper P is immersed in the bleaching solution to effect bleach processing.

The printing paper P after being subjected to bleach processing is transported to a fixing tank 78 located adjacent to the bleaching tank 76. A fixing solution is stored in the fixing tank 78, and the photographic paper P is immersed in the fixing solution to effect fixing processing.

The printing paper P after being subjected to fixing processing is transported to a plurality of washing tanks 79 which are located adjacent to the fixing tank 78 and in which washing water is stored, and the photographic paper P is immersed in the washing water in the washing tanks, so as to effect wash processing.

The printing paper P after being subjected to wash processing is transported to a drying section 80 located above the washing tanks 79. In the drying section 80, the photographic paper P is exposed to warm drying air blown in the direction of arrows B from a chamber 82 disposed below the transporting passage of the photographic paper P, thereby drying the photographic paper P.

A transport passage 84 comprised of a plurality of rollers is disposed downstream of the drying section 80 in the traveling direction of the photographic paper P. The printing paper P which is discharged from the drying section 80 upon completion of drying processing is nipped by these pairs of rollers and is discharged and stacked outside the printer processor 10.

Furthermore, the processor section 72 is provided with a replenishing unit which is comprised of a loading section 300 in which a processing agent kit (which will be described later) is loaded as well as a replenishing tank section for managing replenishing solutions. The loading section 300 mainly manages the processing agent kit as well as carries out the automatic seal opening, automatic cleaning, and drying of the processing solution kit. The replenishing tank section mainly manages the levels of the solutions in the replenishing tanks (which will be described later) and operates the replenishing pumps and circulating/agitating pumps (which will be described later).

It should be noted that the system allows the developing tank 74, the bleaching tank 76, and the fixing tank 78 mentioned above to be replenished with replenishing solutions from replenishing tanks installed in the processor section 72.

Further, a sensor 73 for detecting the amount of the photographic paper P processed is provided at an inlet of the developing tank 74.

<Processing Agent Kit>

Figure 3:
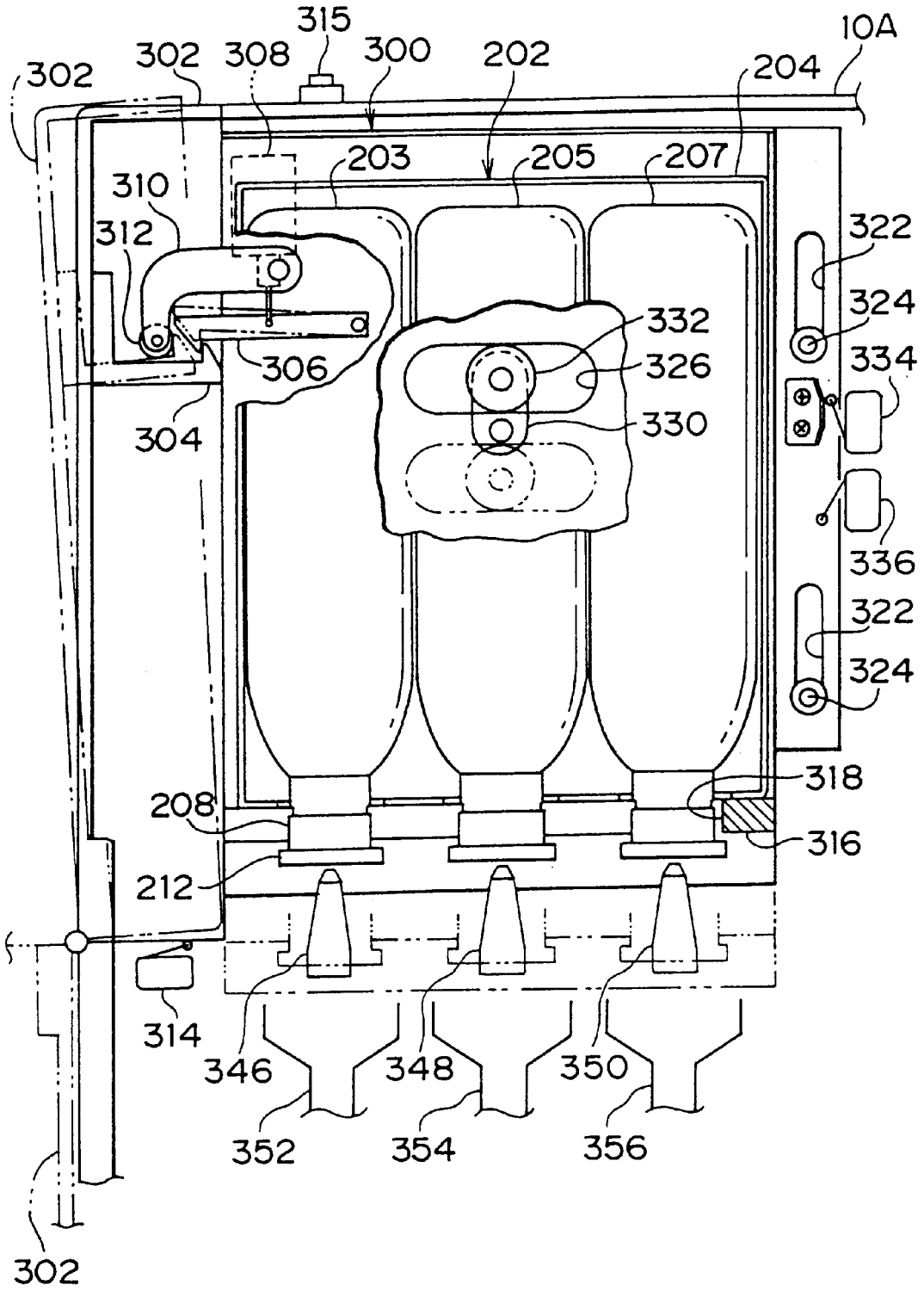
FIG. 3 is a side elevational view of a loading section and its vicinity.

In this embodiment, a system is adopted in which when the quantities of the replenishing solutions in the replenishing tanks have become low, a processing agent kit 202 shown in FIG. 3 is set in the loading section 300 (see FIG. 2) provided on the front side of an upper portion of the casing 10A so as to pour processing agents (replenishing agents in the present invention, which are concentrated suspensions in this embodiment) into the replenishing tanks.

As shown in FIG. 3, in the processing agent kit 202 in this embodiment, a container 203 in which a development processing agent is stored, a container 205 in which a bleach processing agent is stored, and a container 207 in which a fixing processing agent is stored are accommodated in a corrugated cardboard box 204.

It should be noted that since the containers 203, 205, and 207 have the same structures, the structure will be described by taking the container 203 as an example.

Figure 5:
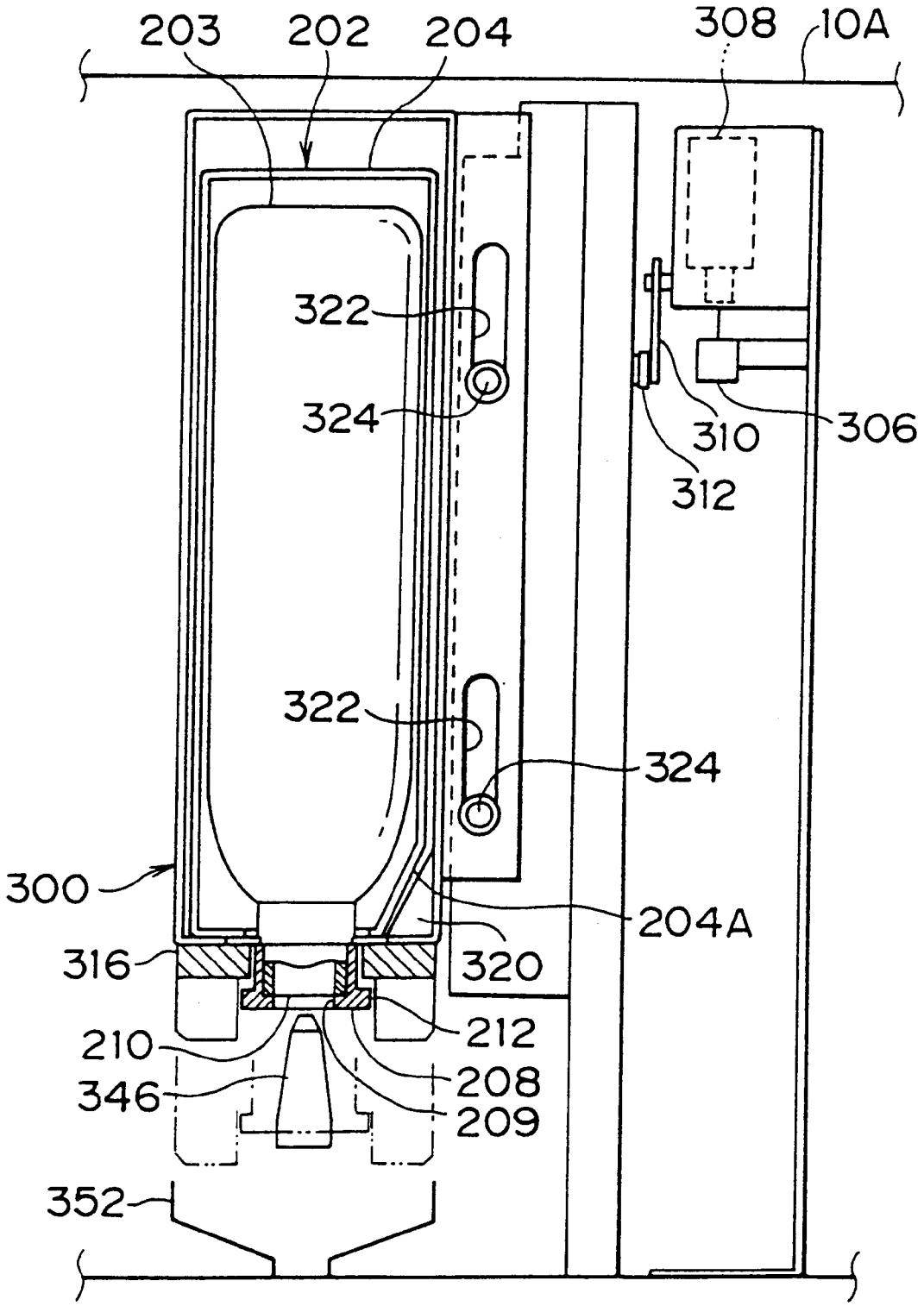
FIG. 5 is a front elevational view of the loading section and its vicinity.

As shown in FIG. 5, the container 203 is provided with a threaded lid 208 projecting from the corrugated cardboard box 204, and a flange 212 is formed on the threaded lid 208. The opening of the container 203 is closed by a seal 210 made of a resin film placed between the opening and the threaded lid 208. A hole 209 is formed in the center of the threaded lid 208, and the seal 210 is arranged so as to be pushed and broken by a cleaning nozzle 346.

In this embodiment, 1,300 ml of the development processing agent is filled in the container 203, 1,300 ml of the bleach processing agent is filled in the container 205, and 1,300 ml of the fixation processing agent is filled in the container 207.

In addition, 3,700 ml of diluting water is added to 1,300 ml of the development processing agent to prepare a replenishing solution (5,000 ml as a completed solution) with which the developing tank 74 is replenished; 700 ml of diluting water is added to 1,300 ml of the bleach processing agent to prepare a replenishing solution (2,000 ml as a completed solution) with which the bleaching tank 76 is replenished; and 700 ml of diluting water is added to 1,300 ml of the fixing processing agent to prepare a replenishing solution (2,000 ml as a completed solution) with which the fixing tank 78 is replenished.

<Loading Section>

As shown in FIG. 3, the loading section 300 is covered with a loading section cover 302 which is openable.

Incidentally, the state in which the loading section cover 302 is closed is indicated by the solid lines in FIG. 3, and the state in which the loading section cover 302 is completely opened is indicated by the phantom lines (two-dotted dash lines) in FIG. 3.

A first lock lever 304 whose leading end is formed in a triangular shape is provided on an inner surface of the loading section cover 302.

Meanwhile, a second lock lever 306 whose leading end is formed in a triangular shape so as to be caught by the leading end of the first lock lever 304 is provided on the casing 10A. The second lock lever 306 is disposed substantially horizontally, and is capable of swinging through a predetermined angle.

A loading cover electromagnetic lock (S743) 308, which is a solenoid, is coupled to the second lock lever 306, and if a current is allowed to flow across the loading cover electromagnetic lock 308, the leading end of the second lock lever 306 is lifted upward.

If the current is not flowing across the loading cover electromagnetic lock 308 with the loading section cover 302 closed, the leading end of the first lock lever 304 is caught by the leading end of the second lock lever 306, preventing the loading section cover 302 from being opened from the outside. In addition, in the state in which the current is allowed to flow across the loading cover electromagnetic lock 308, and the leading end of the second lock lever 306 is lifted upward, the leading end of the first lock lever 304 is not caught by the leading end of the second lock lever 306, so that in this state the loading section cover 302 can be opened.

An L-shaped stopper lever 310 is disposed on the upper side of the first lock lever 304. This stopper lever 310 is capable of swinging through a predetermined angle, and a roller 312 is attached to the leading end thereof.

This stopper lever 310 is arranged so that the roller 312 is urged toward the first lock lever 304 by an unillustrated spring, and so that at the time when the loading section cover 302 is opened, the leading end of the first lock lever 304 abuts against and is caught by the roller 312, and when the loading section cover 302 is further opened, the roller 312 rides over the triangular portion of the first lock lever 304 to completely open the loading section cover 302.

A cover opening/closing detecting switch (D740) 314 for detecting the opening and closing of the loading section cover 302 is provided on the casing 10A, and a cover opening switch (D744) 315, which is pressed at the time of opening the loading section cover 302, is provided on the outer surface of the casing 10A.

A holder 316 for loading the processing agent kit 202 is provided in the loading section 300.

As shown in FIGS. 3 and 5, a slot 318, which is elongated in the depthwise direction and in which neck portions of the containers 203, 205, and 207 are inserted, is formed in the holder 316.

As shown in FIG. 5, a triangular erroneous-loading preventing projection 320 is provided at one lower corner of the loading section 300. A recessed portion 204A which engages with the erroneous-loading preventing projection 320 is formed at one corner of the corrugated cardboard box 204, so that the corrugated cardboard box 204 can be inserted in the proper orientation only.

In the loading section 300, a vertically extending pair of elongated holes 322 are formed in each of a side surface (see FIG. 5) and an inner surface (see FIG. 3). Pins 324 which are secured to the casing 10A are respectively inserted in these elongated holes 322, with the result that the loading section 300 is slidable only in the vertical direction.

Figure 4:
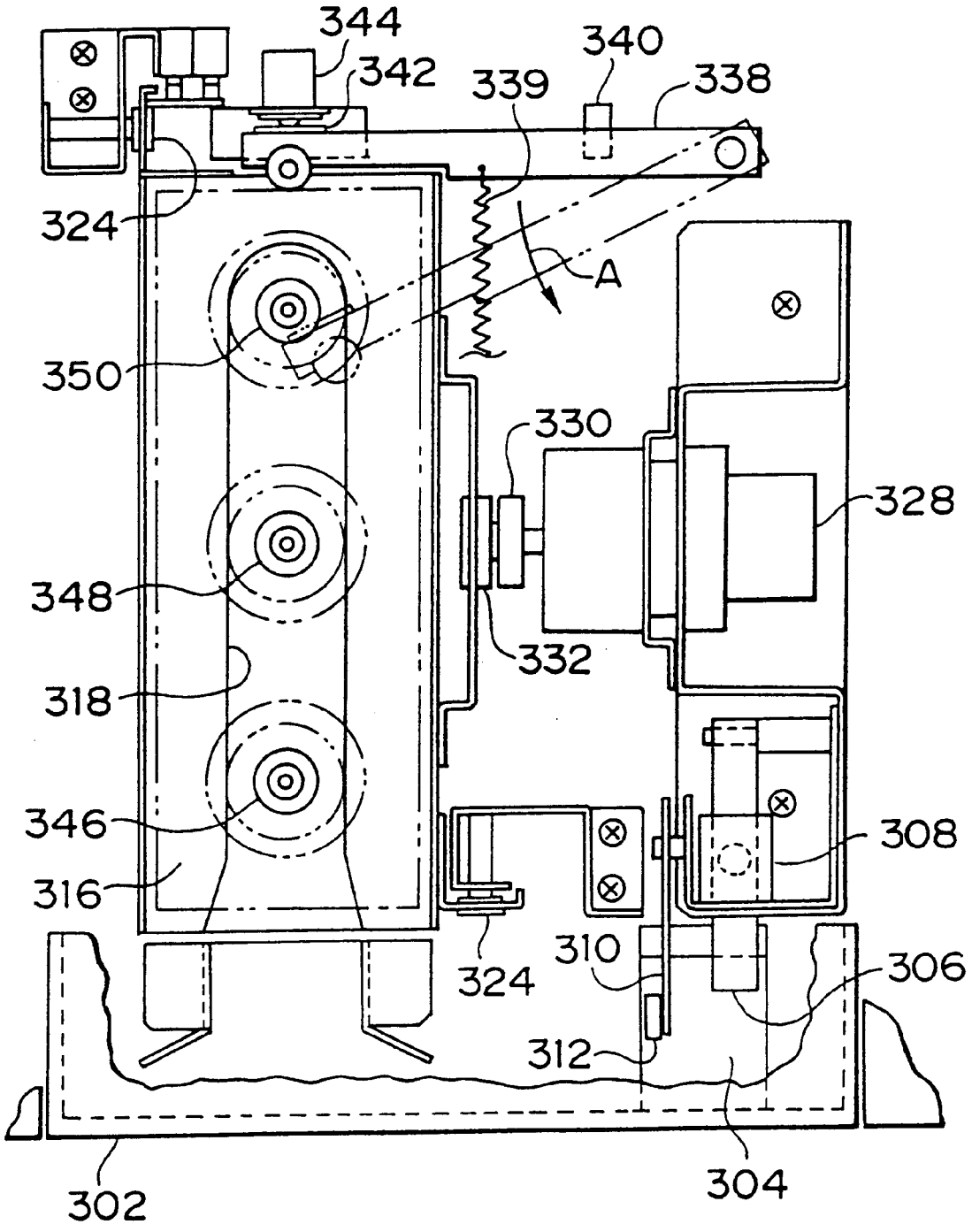
FIG. 4 is a plan view of the loading section and its vicinity.

As shown in FIG. 3, an elongated hole 326 which extends in the horizontal direction is formed in the loading section 300. As shown in FIGS. 3 and 4, a roller 332, attached to a leading end of a link 330, which is rotated by a seal-opening driving motor (M740) 328, is inserted in this elongated hole 326. Accordingly, if the seal-opening driving motor (M740) 328 is rotated, the roller 332 rotates eccentrically, causing the holder 316 to move vertically.

A loading-section upper limit detecting switch (D742) 334 for stopping the loading section 300 at its upper limit position (the position at which the processing agent kit 202 is loaded), as well as a loading-section lower limit detecting switch (D743) 336 for stopping the loading section 300 at its lower limit position (the position at which the lids of the containers 203, 205, and 207 are opened), are provided in the casing 10A.

Figure 10:
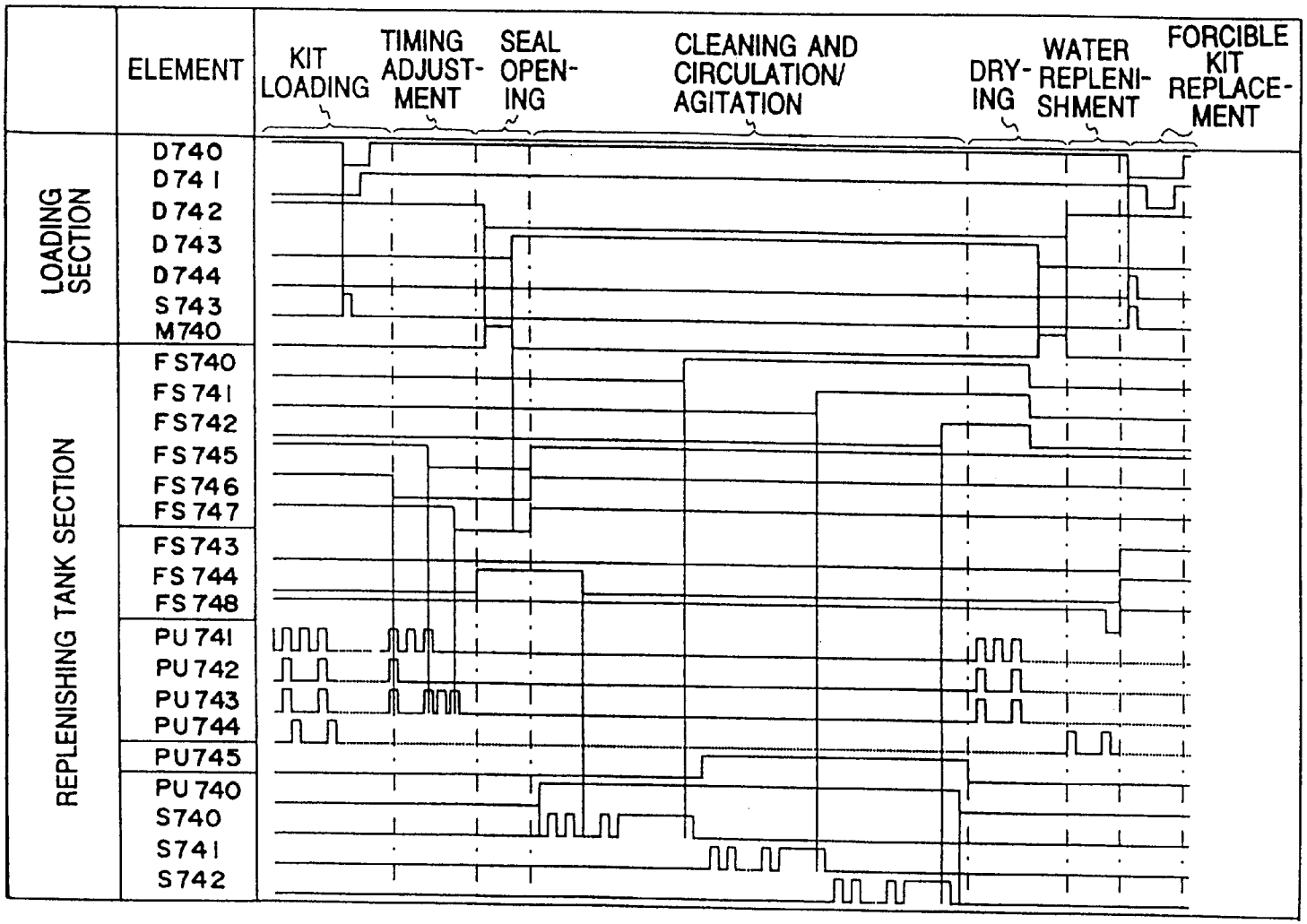
FIG. 10 is a timing chart of the replenishing system.

As shown in FIG. 4, a kit detecting lever 338 which is swingable through a predetermined angle is disposed horizontally in an inner portion of the loading section 300. The kit detecting lever 338 is urged by a spring 339 in the direction of arrow A in FIG. 4, and the arrangement provided is such that when the processing agent kit 202 is pushed into the loading section 300, the processing agent kit 202 abuts against the leading end of the kit detecting lever 338 and causes the kit detecting lever 338 to rotate in an opposite direction to the direction of arrow A, and when the processing agent kit 202 is pushed in to a normal position, a kit detecting switch (D741) 340 is turned on (see the timing chart in FIG. 10) by the kit detecting lever 338.

A striker 342 is attached to a back surface of the kit detecting lever 338, and a latch 344 capable of engaging the striker 342 is provided on the casing 10A on the back side of the kit detecting lever 338.

Here, if the processing agent kit 202 is pushed in to the normal position, the striker 342 engages the latch 344, and if the processing agent kit 202 is pushed in again, the engagement between the striker 342 and the latch 344 is canceled, causing the latch 344 to project by a predetermined amount.

As shown in FIGS. 3 and 5, cleaning nozzles 346, 348, and 350 are provided uprightly below the holder 316 at positions corresponding to the openings of the containers 203, 205, and 207. When the containers 203, 205, and 207 are moved downward, the cleaning nozzles 346, 348, and 350 respectively break through the seal 210 of the container 203, the seal 210 of the container 205, and the seal 210 of the container 207, thereby effecting seal opening.

As shown in FIGS. 3 and 6 to 8, a funnel 352 whose lower end is inserted in a P1R replenishing tank 347 is disposed below the cleaning nozzle 346, a funnel 354 whose lower end is inserted in a P2RA replenishing tank 349 is disposed below the cleaning nozzle 348, and a funnel 356 whose lower end is inserted in a P2RB replenishing tank 351 is disposed below the cleaning nozzle 350.

<Replenishment of Replenishing Solutions>

First, a description will be given of the structure for replenishing a solution by taking the developing tank 74 as an example of the processing tanks.

A development replenishing solution (a development processing agent +cleaning water) is temporarily stored in the P1R replenishing tank 347, so that the developing solution can be activated by being replenished in advance with a predetermined quantity of developing solution, which gradually deteriorates as it is used in the development processing of the photographic paper P in the developing tank 74.

Figure 6:
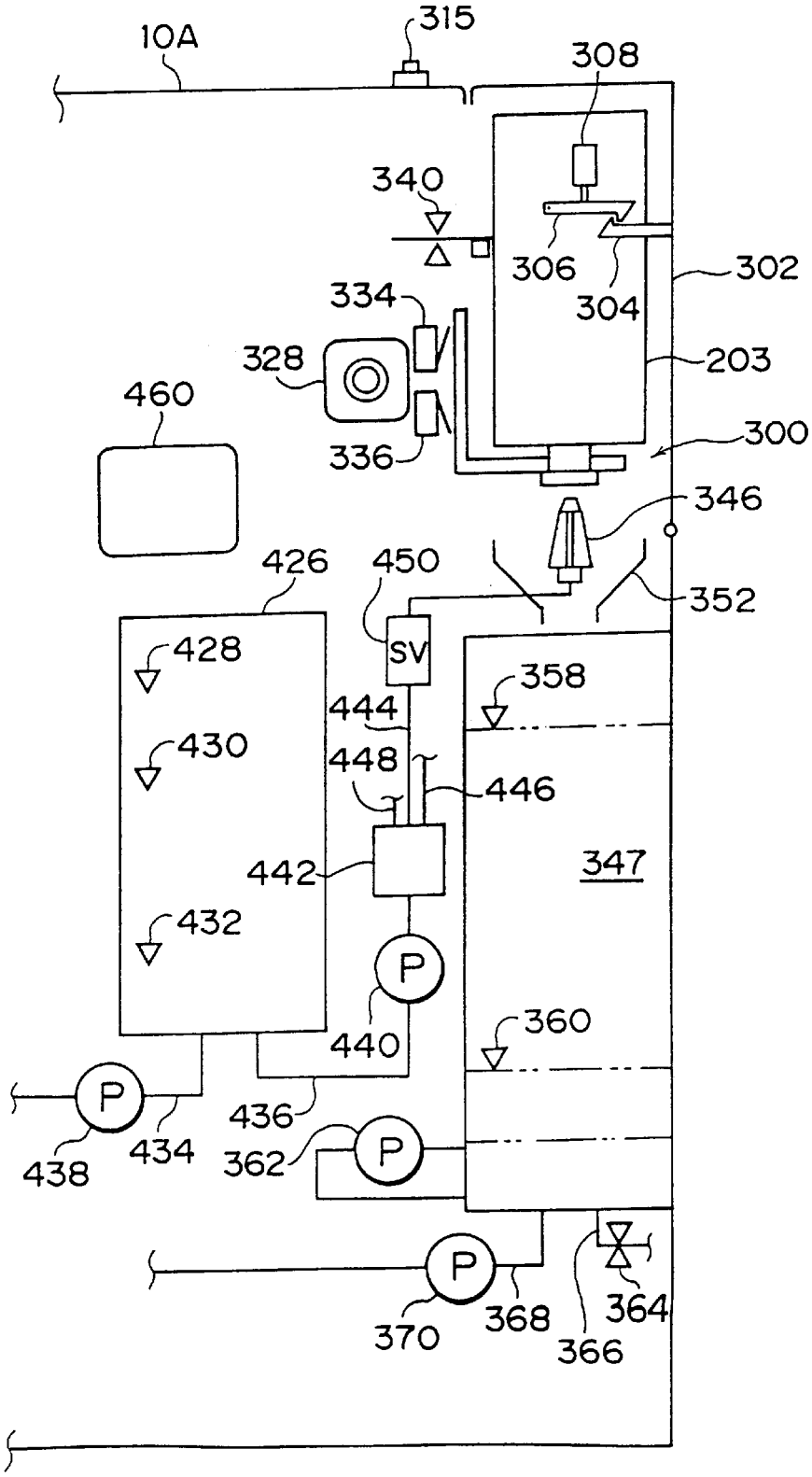
FIG. 6 is a structural diagram of a development replenishing solution system in a replenishing unit.

As shown in FIG. 6, the P1R replenishing tank 347 is provided with an upper limit level sensor (FS740) 358 and a lower limit level sensor (FS745) 360.

The development replenishing solution in the P1R replenishing tank 347 is circulated and agitated by a P1R circulating/agitating pump (PU745) 362 for agitating the solution.

A drain pipe 366 having an on-off valve 364 and a pipe 368 for feeding the solution to the developing tank 74 and the like are connected to the bottom of the P1R replenishing tank 347.

A P1R replenishing pump (PU741) 370 is connected midway in the pipe 368.

Next, a description will be given of the structure for replenishing the bleaching tank 76.

Figure 7:
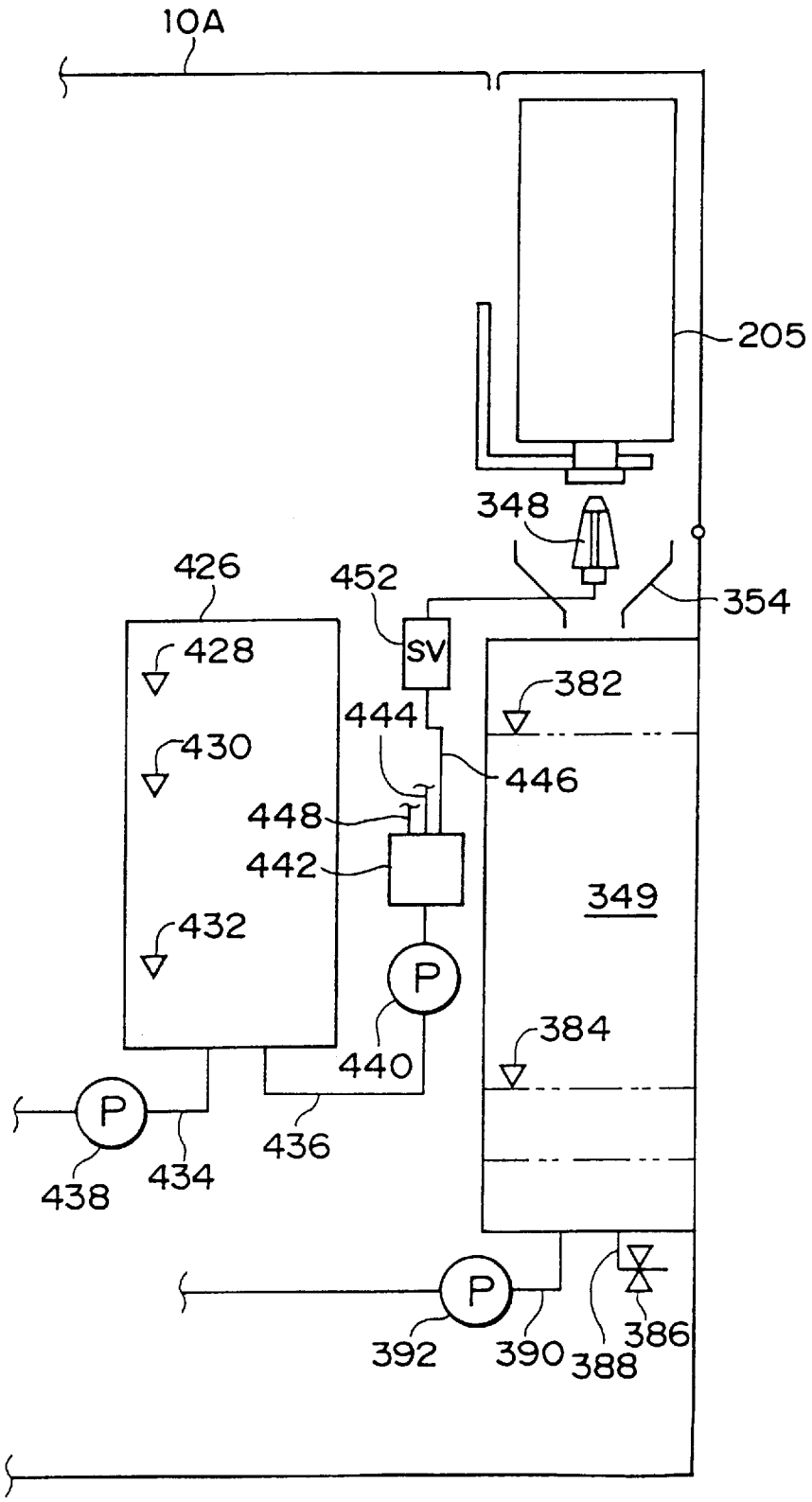
FIG. 7 is a structural diagram of a bleaching replenishing solution system in a replenishing unit.

As shown in FIG. 7, a bleaching replenishing solution (a bleach processing agent+cleaning water) is temporarily stored in the P2RA replenishing tank 349, so that the bleaching solution can be activated by being replenished in advance with a predetermined quantity of the bleaching solution, which gradually deteriorates as it is used in the processing of the photographic paper P in the bleaching tank 76.

The P2RA replenishing tank 349 is provided with an upper limit level sensor (FS741) 382 and a lower limit level sensor (FS746) 384.

A drain pipe 388 having an on-off valve 386 and a pipe 390 for feeding the solution to the bleaching tank 76 and the like are connected to the bottom of the P2RA replenishing tank 349.

A P2RA replenishing pump (PU742) 392 is connected midway in the pipe 390.

Next, a description will be given of the structure for replenishing the fixing tank 78.

Figure 8:
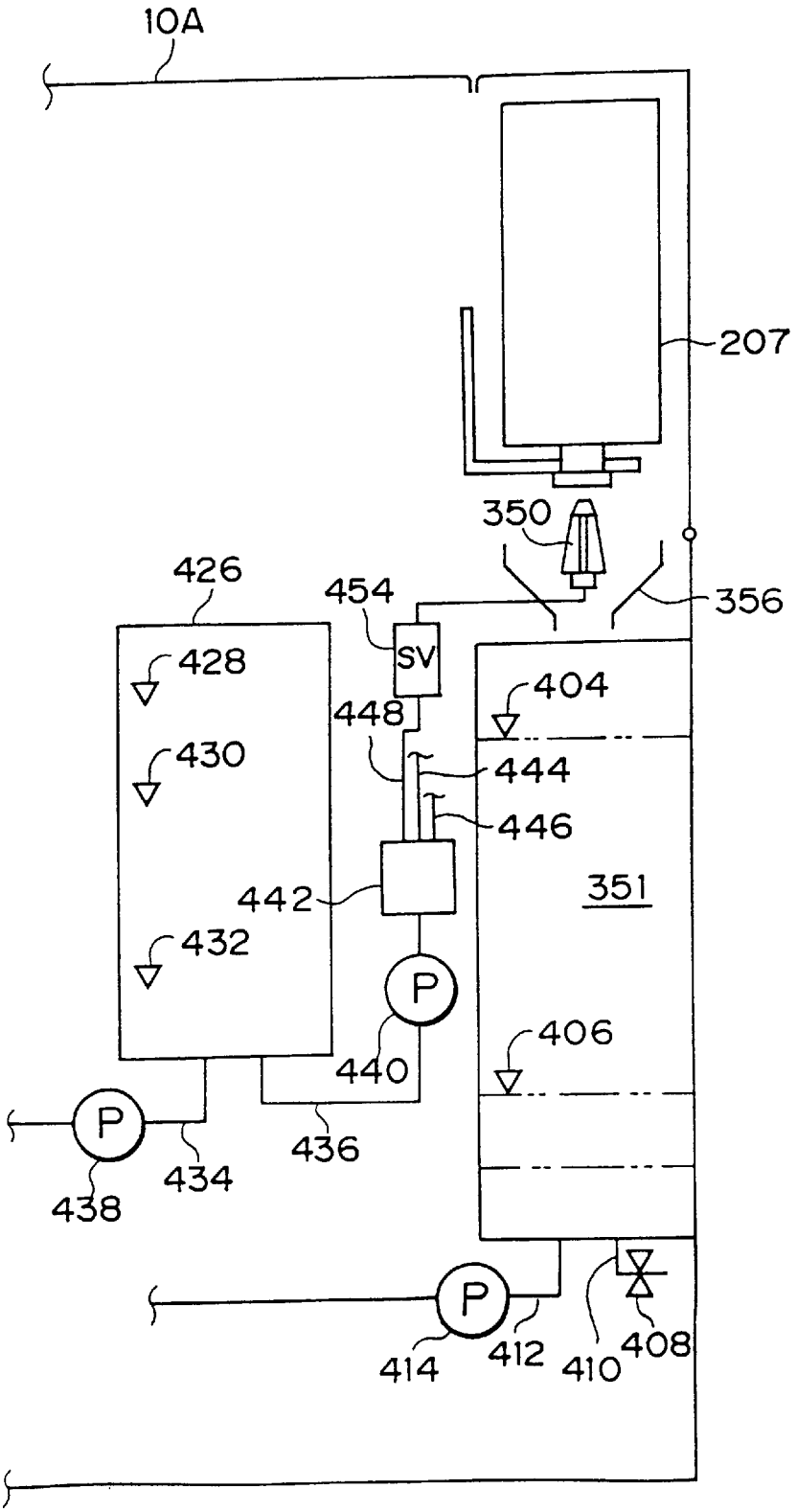
FIG. 8 is a structural diagram of a fixing replenishing solution system in a replenishing unit.

As shown in FIG. 8, a fixing replenishing solution (a fixation processing agent+cleaning water) is temporarily stored in the P2RB replenishing tank 351, so that the fixing solution can be activated by being replenished in advance with a predetermined quantity of the fixing solution, which gradually deteriorates as it is used in the processing of the photographic paper P in the fixing tank 78.

The P2RB replenishing tank 351 is provided with an upper limit level sensor (FS742) 404 and a lower limit level sensor (FS747) 406.

A drain pipe 410 having an on-off valve 408 and a pipe 412 for feeding the solution to the fixing tank 78 and the like are connected to the bottom of the P2RB replenishing tank 351.

A P2RB replenishing pump (PU743) 414 is connected midway in the pipe 412.

<Cleaning Water>

As shown in FIG. 6, a PSR replenishing tank 426 is provided in the casing 10A for cleaning the containers 203, 205, and 207 after the containers have been emptied of the processing agents, and for storing cleaning water (dilution water) for diluting the processing agents (concentrated suspensions).

The PSR replenishing tank 426 is provided with an upper limit level sensor (FS743) 428 for detecting an upper limit level, an intermediate level sensor (FS744) 430 for detecting an intermediate level, and a lower limit level sensor (FS748) 432 for detecting a lower limit level (a predetermined value).

A pipe 324 for feeding water to the washing tank 79 and a pipe 436 for feeding water to the cleaning nozzles 346, 348, and 350 are connected to the bottom of the PSR replenishing tank 426. A PSR replenishing pump (PU744) 438 is provided midway in the pipe 434, and its leading end is connected to the washing tank 79.

Meanwhile, a container cleaning pump (PU740) 440 is connected midway in the pipe 436, and pipes 444, 446, and 448 are connected to its leading end via a distributor 442.

A development-processing-agent container cleaning valve (S740) 450 is connected midway in the pipe 444, and its leading end is connected to the cleaning nozzle 346.

A bleach-processing-agent container cleaning valve (S741) 452 is connected midway in the pipe 446, and its leading end is connected to the cleaning nozzle 348, as shown in FIG. 7.

A fixation-processing-agent container cleaning valve (S742) 454 is connected midway in the pipe 448, and its leading end is connected to the cleaning nozzle 350, as shown in FIG. 8.

The aforementioned solenoids, switches, motors, sensors, and solenoid valves are connected to a controlling means 460, and a display unit 122 (see FIG. 2) is connected to the controlling means 460. The operating condition of the apparatus, message to the operator, and the like are displayed on the display unit 122.

<States of the Replenishing Tanks>

Next, a description will be given of the states of the replenishing tanks. The replenishing tanks are classified into various states depending on factors not influenced by the level of the solution in the areas covered by the sensors, as shown in the schematic diagram in FIG. 9.

States A to H of the solution (the shaded portion indicates the solution) schematically indicate the states of the solution in the replenishing tank.

A: shows the state in which the replenishment of the processing solution is continued until the replenishing tank is empty (in actual fact, the replenishing tank is controlled so as not to reach this state).

B: the position immediately before the seals are automatically opened in the normal state.

C: the replenishing solution limit at which replenishment of the processing liquid can still be carried out without supplying the processing agent.

D: the state after the replenishment of the processing agent by automatically opening the seals in state B.

E: the state after the replenishment of the processing agent by automatically opening the seals in state C.

F: the state after the container was cleaned in the state D, and filled with dilution water (cleaning water).

G: the state of the container after being filled with maximum amounts of both the processing agent and the dilution water.

H: the level of the surface of the liquid at which the loading of the processing agent kit is notified (prompted) after the processing tank has been replenished with the processing solution.

Figure 9:
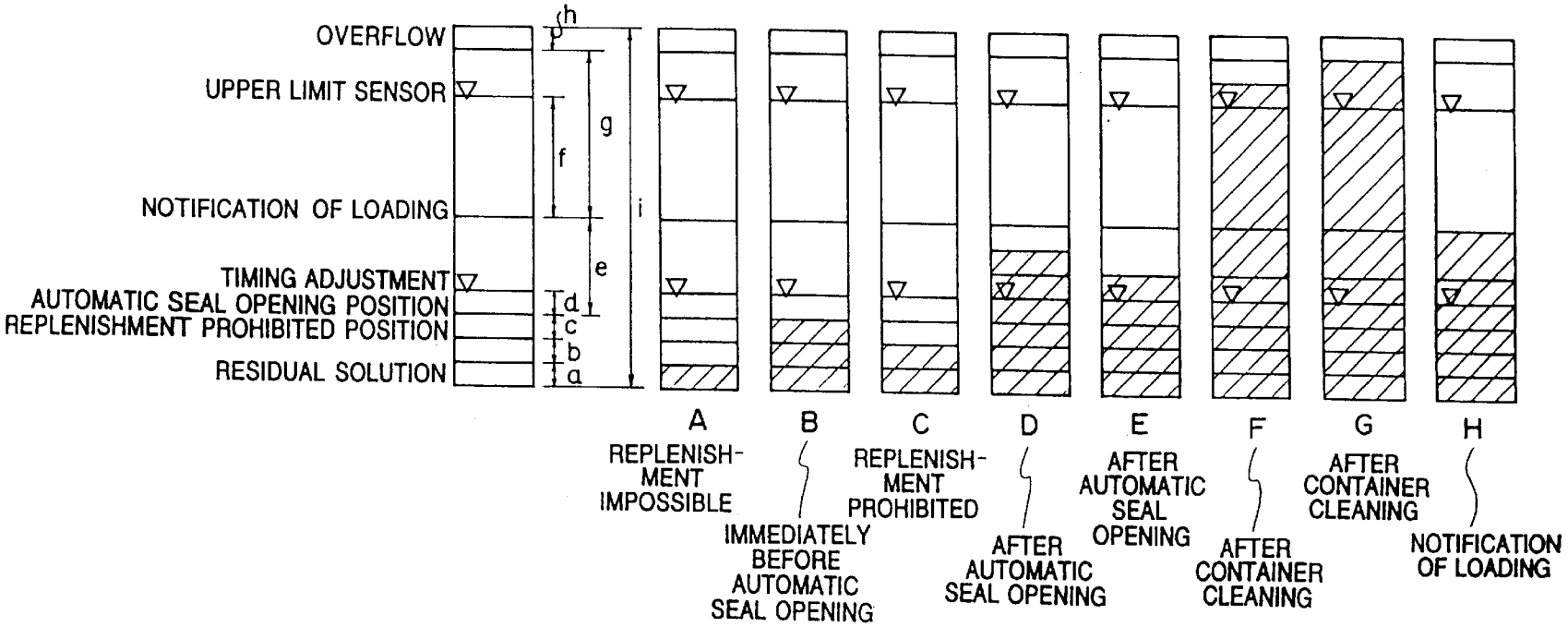
FIG. 9 is an explanatory diagram illustrating states of the solution in a replenishing tank.

In addition, liquid volumes a to i in FIG. 9 will be described below.

a: residual solution volume: the residual portion (can be discharged from the drain pipe) when the processing tank has been replenished with replenishing solution until the supply of replenishing solution is exhausted a+b: replenished residual volume: the residual amount normally remaining even when the maximum amount of replenishing solution is supplied to the processing tank c: buffer volume: the buffer amount for replacement of the processing agent kit when the seals of an empty processing agent kit are opened d: volume for maintaining sensor accuracy: a portion for stabilizing the detection by the lower limit level sensor e: volume for a day's processing: the buffer portion for permitting the loading of the processing agent kit first thing in the morning f: volume for notification of loading: the volume for determining the timing for notification of loading from the upper limit level sensor e+g: completed solution volume of one kit: the completed solution volume in which the processing agent in one kit is diluted h: overflow volume: the buffer portion when the tank is full of solution i: internal volume of the replenishing tank: the necessary minimum internal volume of the replenishing tank In this embodiment, the aforementioned liquid volumes a to i for the P1R replenishing tank are set to values shown in Table 1 below.

TABLE 1

| | Set values for P1R replenishing tank (ml) |
|---|---|
| a | 100 |
| b | 100 |
| c | 100 |
| d | 100 |
| e | 2,000 |
| f | 2,000 |
| g | 3,600 ± 1,000 |
| h | 100 |
| i | 6,000 |

It should be noted that, in this embodiment, the P1R replenishing tank 347, the P2RA replenishing tank 349, and the P2RB replenishing tank 351 are formed in cylindrical shapes.

Here, in the P1R replenishing tank 347, the position of the lower limit level sensor (FS745) 360 is set to 400 ml from the bottom of the tank, and the position of the upper limit level sensor (FS740) 358 is set to 4,300 ml from the bottom of the tank.

<States of the Loading Section>

Next, a description will be given of the states and operation of the loading section 300.

The operation of the loading section 300 includes five kinds of operation, (1) "loading of the processing agent kit," (2) "driving of the loading section," (3) "supplying of cleaning water," (4) "maintaining of the seal-opened state," and (5) "withdrawal of the loading section."

The modes of operation of the replenishing unit include "adjustment of replenishment timing" and "processing replenishment, processing correction, and dilution water correction" using the P1R replenishing pump (PU741) 370, the P2RA replenishing pump (PU742) 392, the P2RB replenishing pump (PU743) 414, the PSR replenishing pump (PU744) 438, and the container cleaning pump (PU740) 440, as well as "circulation and agitation" using the P1R circulating/agitating pump (PU745) 362.

(1) "Loading of Processing Agent Kit" (Management of Processing Agent Kit)

When the processing agent kit 202 is not loaded, or the processing agent kit 202 in the loaded state has been used up, the loading section cover 302 is made openable to prompt the loading of a new processing agent kit 202 in the loading section 300.

This process is commenced under any one of the following conditions:

(A) When a predetermined quantity of processing replenishment has been effected after the upper limit level sensor (FS740) 358 in the P1R replenishing tank 347 has detected that the solution is exhausted.

(B) If the exhaustion of the solution has been detected by all the lower limit level sensors in the replenishing tanks (the lower limit level sensor (FS745) 360, the lower limit level sensor (FS746) 384, and the lower limit level sensor (FS747) 406) even after the lapse of a fixed time duration subsequent to the driving (seal-opening operation) of the loading section 300.

(C) If the cover opening switch (D744) 315 has been pressed in the state in which the kit can be loaded (in the upper limit position for loading).

In addition, the process ends under the following condition:

When the loading or reloading of the kit is detected.

The sequence of operation is as follows:

The loading section cover 302 is unlocked (the loading cover electromagnetic lock (S743) 308 is turned on) under the following conditions:

(a) When a predetermined quantity ($Q_4$) has been processed and replenished after the upper limit level sensor (FS740) 358 in the P1R replenishing tank 347 detected "no solution," or (b) the holder 316 of the loading section 300 is at its upper limit, and (c) the cover opening switch (D744) 315 is on, or (d) the processing agent kit 202 is not detected during the automatic seal-opening operation of the processing agent kit (which will be described later).

The loading section cover 302 is locked (the loading cover electromagnetic lock (S743) 308 is turned off) under the following condition (e):

(e) The status of detection of the loading of the kit is "undetected→detected," and "detected→undetected→detected," and the cover opening/closing detecting switch (D740) 314 is off (the loading section cover 302 is in the closed state).

In the aforementioned items of operation, the following are notified:

(i) Notification of "LOAD PROCESSING AGENT KIT" (the notification to load is made when the main power of the printer processor 10 is turned on). (For items (a) and (d) above)

(ii) Notification of "LOADING SECTION COVER IS CLOSED." (For item (e) above)

(iii) Notification of "LOADING SECTION COVER IS OPENABLE." (For items (a) and (b) above)

(2) Driving of Loading Section (Automatic Seal-Opening of Processing Agent Kit)

The seals of the processing agent kit 202 (containers 203, 205, and 207) are opened by means of the cleaning nozzles 346, 348, and 350 by driving the loading section 300.

This process is commenced under the following condition:

When the P1R replenishing tank 347, the P2RA replenishing tank 349, and the P2RB replenishing tank 351 have entered a state of "management with no solution" (which will be described later) (when the levels of the surfaces of the liquids in all the processing tanks have reached the levels normal immediately before the end of processing).

The process ends under the following condition:

When the replenishing tanks have been replenished with the processing agents, and the lower limit level sensors in the replenishing tanks (the lower limit level sensor (FS745) 360, the lower limit level sensor (FS746) 384, and the lower limit level sensor (FS747) 406) have detected the presence of solutions.

The sequence of operation is as follows:

Under the conditions (A) to (E) listed below, the seal-opening driving motor (M740) 328 is operated until the lower limit of the loading section is detected, and the seals of the processing agent kit 202 (containers 203, 205, and 207) are opened. Notifications of "CLOSE LOADING SECTION COVER" and "OPENING OF LOADING SECTION COVER IS IMPOSSIBLE" are given on the display unit 122.

(A) The intermediate level sensor (FS744) 430 in the PSR replenishing tank 426 has detected the presence of solution.

(B) The holder 316 of the loading section 300 is at its upper limit.

(C) The processing agent kit 202 has been loaded.

(D) The loading section cover 302 is in a closed and locked state.

(E) The cover opening switch (D744) 315 is off. After the seal opening, the seal-opening driving motor (M740) 328 is temporarily stopped for a predetermined time ($t_1$).

(a) The sequence ends if the lower limit level sensor (FS745) 360, the lower limit level sensor (FS746) 384, and the lower limit level sensor (FS747) 406 of the P1R replenishing tank 347, the P2RA replenishing tank 349, and the P2RB replenishing tank 351 have all detected that there is solution.

(b) If the presence of solution is not detected by all of the lower limit level sensor (FS745) 360, the lower limit level sensor (FS746) 384, and the lower limit level sensor (FS747) 406 of the P1R replenishing tank 347, the P2RA replenishing tank 349, and the P2RB replenishing tank 351, the notification of "LOAD PROCESSING AGENT KIT" is given on the display unit 122. After the operator has loaded a new processing agent kit 202, the sequence is restarted.

(c) If the presence of solution is not detected by one or two lower limit level sensors of the P1R replenishing tank 347, the P2RA replenishing tank 349, and the P2RB replenishing tank 351, the apparatus is considered to be in an abnormal state.

In the aforementioned items of operation, the following are notified:

(i) Notification of "SUPPLY WATER." (This notification is given when the intermediate level sensor (FS744) 430 has not detected the presence of solution). The operator replenishes cleaning water to the PSR replenishing tank 426.

(ii) Notification of "OPENING OF LOADING SECTION COVER IS IMPOSSIBLE" (During the execution of the sequence of this operation)

(iii) Notification of "ABNORMALITY IN APPARATUS." (For item (C) above)

(3) "Supplying of Cleaning Water" (Automatic Cleaning of Processing Agent Kit)

The interior of the containers 203, 205, and 207 is cleaned by feeding diluting and cleaning water into the containers 203, 205, and 207 of the processing agent kit 202.

This process is started after completion of the seal opening of the processing agent kit 202. The process ends when a predetermined quantity of diluting and cleaning water has been supplied, and the upper limit level sensors in the respective replenishing tanks have detected the presence of solution.

The sequence of operation is as follows:

1) The container cleaning pump (PU740) 440 is started.

2) The development-processing-agent container cleaning valve (S740) 450 is opened and closed for a predetermined time. This operation is repeated a predetermined number of times.

3) Finally, the development-processing-agent container cleaning valve (S740) 450 is opened and closed for a final predetermined time ($t_{31}$). At this time, a corrected numeral value is used as $t_{31}$.

4) The above steps 2) and 3) are carried out for the P2RA replenishing tank 349 as well (final predetermined time ($t_{32}$)). At this time, a corrected numeral value is used as $t_{32}$.

5) The above steps 2) and 3) are carried out for the P2RB replenishing tank 351 as well (final predetermined time ($t_{32}$)). At this time, a corrected numeral value is used as $t_{32}$.

6) The operation ends if the presence of solution is detected by the upper limit level sensors (the upper limit level sensor (FS740) 358, the upper limit level sensor (FS741) 382, and the upper limit level sensor (FS742) 404) in the P1R replenishing tank 347, the P2RA replenishing tank 349, and the P2RB replenishing tank 351.

It should be noted that the open time durations of the development-processing-agent container cleaning valve (S740) 450, the bleach-processing-agent container cleaning valve (S741) 452, and the fixation-processing-agent container cleaning valve (S742) 454 are set as shown in Table 2 below, and this valve opening operation is executed with the accuracy of ±10 ms.

TABLE 2

| Cleaning valve | No. of chargings excluding final charging | Open time per charging until immediately before final charging | Open time in final charging |
|---|---|---|---|
| S740 | $n_{21} = 10$ | $t_{21} = 2$ sec. | $t_{31} = 60$ sec. |
| S741 | $n_{22} = 10$ | $t_{22} = 2$ sec. | $t_{32} = 10$ sec. |
| S742 | $n_{22} = 10$ | $t_{22} = 2$ sec. | $t_{32} = 10$ sec. |

(4) and (5) "Maintaining of Seal-Opened State" and "Withdrawal of Loading Section" (Drying of Processing Agent Kit)

In this process, the containers 203, 205, and 207 are maintained in open states, and are allowed to dry naturally.

This process is commenced upon completion of the cleaning of the containers 203, 205, and 207.

This process ends under any one of the following conditions:

(A) When a predetermined time duration has lapsed.

(B) If the lower limit level sensor (FS745) 360 in the P1R replenishing tank 347 has detected that there is no solution.

(C) If the cover opening switch (D744) 315 has been pressed.

The process ends after the holder 316 of the loading section 300 is stopped at its lower limit position for a predetermined time (which is variable) after cleaning and the containers 203, 205, and 207 are allowed to dry naturally, or after the holder 316 of the loading section 300 is returned its upper limit position for item (B) or (C) above.

In the above operation, the following is notified:

The notification of "COVER IS OPENABLE." (For item (A) or (B) above)

<Management of Solution Levels in Replenishing Tanks>

"Management of Solution levels in P1R Replenishing Tank 347, P2RA Replenishing Tank 349, and P2RB Replenishing Tank 351"

There are three states of solution levels in the P1R replenishing tank 347, the P2RA replenishing tank 349, and the P2RB replenishing tank 351 in terms of replenishment, namely, the state when "solution present," the state when "volume of solution is small," and the state when "no solution." The operation for these states includes three kinds of operation: (1) "management when there is solution present," (2) "management when the volume of solution is small," and (3) "management when there is no solution."

In all of these states, replenishment volumes A+B and A+B+C are monitored.

I. The solution volume between the lower limit level and a minimum solution level is set as A.

II. The solution volume between the maximum solution level and the upper limit level is set as B.

III. The solution volume between the upper limit level and the lower limit level is set as C.

The replenishment volume of one kit (replenishment processing agent+cleaning and diluting water)=A+B+C (1) "Management When There Is Solution Present"

The solution levels are individually monitored when "solution present" is detected by the lower limit level sensors in the respective replenishing tanks.

The sequence of operation is as follows:

(a) The operation proceeds to "management when there is solution present" under either of the following conditions:

(1) Immediately after the automatic cleaning of the processing agent kit 202.

(2) When the upper limit level sensor (FS740) 358, the upper limit level sensor (FS741) 382, and the upper limit level sensor (FS742) 404 in the replenishing tanks have detected "solution present."

(b) The replenishment volumes A, B, and C are monitored (c) The operation proceeds to "management when the volume of solution is small" under the following condition:

If the lower limit level sensor (FS745) 360, the lower limit level sensor (FS746) 384, and the lower limit level sensor (FS747) 406 in the replenishing tanks have detected "no solution."

(2) "Management When the Volume of Solution Is Small"

This is the case where "no solution" is detected by the lower limit level sensors in the respective replenishing tanks, and the solution levels are individually monitored.

While "no solution" is detected by the lower limit level sensors, predetermined replenishment quantities (100 ml in P1R) are replenished, and the loading of the processing agent kit is prompted.

The sequence of operation is as follows:

(a) The operation proceeds to "management when the volume of solution is small" under the following condition:

In "management when there is solution present," the replenishment of processing solutions is continued up to the aforementioned predetermined replenishment volumes at which levels the lower limit level sensor (FS745) 360, the lower limit level sensor (FS746) 384, and the lower limit level sensor (FS747) 406 detect "no solution."

(b) The replenishment volume A is monitored.

(c) The operation proceeds to "management when there is no solution" under the following condition:

When replenishment is completed up to the aforementioned predetermined replenishment volume.

(3) "Management When There Is No Solution"

This is the case where the lower limit level sensor (FS745) 360, the lower limit level sensor (FS746) 384, and the lower limit level sensor (FS747) 406 in the P1R replenishing tank 347, the P2RA replenishing tank 349, and the P2RB replenishing tank 351 have detected "no solution," and the solution levels are individually monitored. In the case where after a predetermined replenishment quantity in the "management when the volume of solution is small" is replenished, an allowable replenishment quantity (100 ml in P1R) is replenished from that replenishing tank, the notification of "REPLENISHING SOLUTION COMPLETELY EXHAUSTED" is given.

The sequence of operation is as follows:

(a) The operation proceeds to "management when there is no solution" under the following condition:

Upon completion of "management when the volume of solution is small."

(b) The replenishment volume A is monitored.

(c) The automatic seal opening of the processing agent kit and the automatic cleaning of the processing agent kit are carried out.

(d) Upon completion of the above operation, the operation proceeds to "management when there is solution present."

(e) If the quantity of processing and replenishment has reached an allowable replenishment quantity during the above operation, the state changes to "REPLENISHING SOLUTION COMPLETELY EXHAUSTED."

In the above operation, the following is notified:

The notification of "REPLENISHING SOLUTION COMPLETELY EXHAUSTED." (For item (e) above)

<Adjustment of Replenishment Timing>

In the case of the present formulation, since the capacity of the processing agent kit is adjusted in advance to the replenishment ratio among the processing agents in the P1R replenishing tank 347, the P2RA replenishing tank 349, and the P2RB replenishing tank 351, replenishment is effected in such a way that the processing agents in the developing tank 74 and the other tanks (the bleaching tank 76 and the fixing tank 78) are replenished at the same times and that their consumption is finished at the same times with respect to a predetermined quantity of processing of paper (photographic printing paper P). The operation of adjustment of the replenishment timing has a higher priority than the seal opening operation.

The states of solution level include three states, i.e., (1) "the volumes become small in all the tanks at the same times," (2) "the volume in the P1R replenishing tank becomes small earlier than that in the other replenishing tanks," and (3) "the volumes in the other replenishing tanks become small earlier than that in the P1R replenishing tank."

There are three operations for these states: (1) "management for the reaching of lower limits for all replenishing tanks," (2) "management when the lower limit tends to be reached earlier in the development replenishing tank," and (3) "management when the lower limits tend to be reached earlier in the other replenishing tanks."

(1) "Management for the Reaching of Lower limits for All Replenishing Tanks"

Monitoring is carried out so that the P1R replenishing tank 347, the P2RA replenishing tank 349, and the P2RB replenishing tank 351 all simultaneously reach the state in which "the volume of solution is small."

The sequence is commenced under the following condition:

In a case where, after the system start or an error reset, any one of the lower limit level sensors (the lower limit level sensor (FS745) 360, the lower limit level sensor (FS746) 384, and the lower limit level sensor (FS747) 406) in the P1R replenishing tank 347, the P2RA replenishing tank 349, and the P2RB replenishing tank 351 has detected that "the volume of solution is small."

The sequence ends under one one of the following conditions:

When the system is terminated by turning off the power supply.

When the lower limit level sensor has detected "no solution" in one or two tanks (in which case the operation proceeds to "management when the lower limit tends to be reached earlier in the development replenishing tank" or "management when the lower limits tend to be reached earlier in other replenishing tanks."

When the lower limit level sensor (FS745) 360, the lower limit level sensor (FS746) 384, and the lower limit level sensor (FS747) 406 have simultaneously detected "no solution."

(2) "Management When the Lower Limit Tends to Be Reached Earlier in the Development Replenishing Tank"

When the lower limit level in the P1R replenishing tank tends to reach the state in which "the volume of solution is small" earlier than in the other replenishing tanks, processing replenishment is effected so as to adjust the slow timings of the other tanks.

The sequence is commenced under either of the following conditions:

In the case where, after the system start or an error reset, the lower limit level sensor (FS745) 360 has detected "no solution."

When the lower limit level sensor (FS745) 360 has detected a shift from "no solution" to "solution present."

The sequence ends under one of the following conditions:

When the system is terminated by turning off the power supply.

When both the lower limit level sensor (FS746) 384 and the lower limit level sensor (FS747) 406 in the P2RA replenishing tank 349 and the P2RB replenishing tank 351 have detected "no solution" (in which case the operation proceeds to (1) "management for the reaching of lower limits for all replenishing tanks").

The sequence of operation is as follows:

(a) The replenishing tank whose solution level has not reached the lower limit level is immediately replenished with a predetermined quantity of replenishing solution.

(b) The replenishment quantity for allowing the level of the solution to reach the lower limit level is calculated (a predetermined replenishment quantity×the actual number of replenishings). At this time, the replenishing tank is replenished with solution up to a volume which does not exceed the management range of the replenishment volume A.

(3) "Management When the Lower Limits Tend to Be Reached Earlier in Other Replenishing Tanks"

In the case where either one or both of the lower limit level sensor (FS746) 384 and the lower limit level sensor (FS747) 406 in the P2RA replenishing tank 349 and the P2RB replenishing tank 351 have detected that "the volume of solution is small" earlier than the P1R replenishing tank 347, replenishment to the replenishing tank for which the timing of detection of the "small volume of solution" is earlier is stopped.

The sequence is commenced under the following condition:

In the case where, after the system start-up, both the lower limit level sensor (FS746) 384 and the lower limit level sensor (FS747) 406 in the P2RA replenishing tank 349 and the P2RB replenishing tank 351 have detected that "the volume of solution is small."

The sequence ends under either of the following conditions:

When the system is terminated by turning off the power supply.

When the lower limit level sensor (FS745) 360 in the P1R replenishing tank 347 has detected "no solution" (in which case the operation proceeds to (1) "management when the lower limit tends to be reached earlier in the development replenishing tank").

The sequence of operation is as follows:

(a) As for the replenishing tank whose solution level reached the lower limit level, replenishment is stopped until the solution level of the P1R replenishing tank 347 reaches its lower limit level.

(b) The quantity of paper processed (photographic printing paper P) after entering this management is calculated.

(c) The sequence is stopped in a range which does not exceed the predetermined quantity of paper processed (photographic printing paper P).

<Processing Replenishment, Processing Correction, and Dilution Water Correction>

Replenishment of processing solutions corresponding to the quantity of paper processed (photographic printing paper) is effected. In addition, the replenishment amounts are automatically revised for each processing agent kit so as to maintain replenishment accuracy.

The sequence of operation is as follows:

In processing replenishment, after the predetermined quantity of paper has been processed, replenishment is effected by one unit amount of operation of the pump.

In processing correction and dilution water correction, the replenishment quantities and the quantity of dilution water are revised by using actual replenishment quantities which are monitored in the above-described "management of solution levels in P1R replenishing tank 347, P2RA replenishing tank 349, and P2RB replenishing tank 351."

In processing replenishment, the replenishment quantities are corrected as follows:

With respect to the P1R replenishing tank 347, the P2RA replenishing tank 349, and the P2RB replenishing tank 351, their actual replenishment volumes A+B+C (an actual replenishment quantity $Q_{b1}$×an actual number of times $n_{1i}$, including portions adjusted for the replenishment timing) are compared with the predetermined replenishment quantities shown in Table 3 below.

TABLE 3

| | P1R | P2RA | P2RB |
|---|---|---|---|
| $Q_{ai}$ ml × $n_{0i}$ times | $Q_{a1} \times n_{01}$ = 50 × 100 | $Q_{a2} \times n_{02}$ = 50 × 40 | $Q_{a2} \times n_{02}$ = 50 × 40 |

If the actual number of replenishings ($n_{1i}$)≈the predetermined number of times ($n_{0i}$), the following correction is added to the replenishment quantity. In this case, since $n_{0i} \times Q_{ai} = n_{1i} \times Q_{bi}$=the completed solution volume of one kit (i=1, 2), the replenishment quantity for the next time is set as follows:

Subsequent replenishment quantity=$n_{1i}$×most recently set replenishment amount/$n_{0i}$ Although this correction is effected each time the completed solution of one kit is consumed, if comparison is made between the initial predetermined replenishment quantity ($Q_{ai}$) and the corrected value of each time, and the result exceeds the range shown in Table 4 below, the sequence is interrupted, and "ABNORMALITY" is notified on the display unit 122.

TABLE 4

| | P1R | P2RA | P2RB |
|---|---|---|---|
| $Q_{ai}$ ml ± $q_{bi}$ ml | $Q_{a1} \pm q_{a1}$ × 50 ± 10 | $Q_{a2} \pm q_{a2}$ = 50 ± 10 | $Q_{a2} \pm q_{a2}$ = 50 ± 10 |

The correction of dilution water is as follows:

Actual replenishment volumes A+B (an actual replenishment quantity $Q_{b1}$×an actual number of times $n_{4i}$, including portions adjusted for the replenishment timing) is compared with the predetermined replenishment quantity. For example, the calculation for P1R is shown in Table 5 below.

TABLE 5

| | P1R |
|---|---|
| $Q_{ai}$ ml × $n_{3i}$ times | $Q_{a1} \times n_{31}$ = 50 × 78 |

If the actual number of replenishings ($n_{4i}$)≈the predetermined number of times ($n_{3i}$), the following correction is made to the quantity of dilution water.

In this case, since $$n_{3i} \times Q_{ai} = n_{4i} \times Q_{bi} = \text{the completed solution volume of one kit} - \text{the completed solution volume from the upper limit to the lower limit level} \quad (i = 1, 2)$$

so that the quantity of dilution water for the next time is set as follows:

$$\text{quantity of dilution water set for the next time} = \text{the most recently set quantity of dilution water} - (n_{4i} - n_{3i}) \times \text{the most recently set replenishment quantity}$$

Although this correction is effected for P1R, P2RA, and P2RB each time the completed solution of one kit is consumed, if comparison is made between the initial predetermined quantity of dilution water ($Q_{ci}$) and the corrected value of each time, and the result exceeds the range shown in Table 6 below, the sequence is interrupted, and "ABNORMALITY" is notified.

TABLE 6

| | P1R | P2RA | P2RB |
|---|---|---|---|
| $Q_{ci}$ ml ± $q_{ci}$ ml | $Q_{c1} \pm q_{c1}$ = 3700 ± 370 | $Q_{c2} \pm q_{c2}$ = 700 ± 70 | $Q_{c2} \pm q_{c2}$ = 700 ± 70 |

The opening and closing times of the development-processing-agent container cleaning valve (S740) 450, the bleach-processing-agent container cleaning valve (S741) 452, and the fixation-processing-agent container cleaning valve (S742) 454, which are opened and closed during the next automatic cleaning of the processing agent kit, is calculated and revised on the basis of the quantity of dilution water set for the next time.

Since the quantity of dilution water is expressed by $$\text{quantity of dilution water} = \text{quantity of dilution water} / \text{unit time} \times (t_{2i} \times n_{2i} + t_{3i}) \quad (i = 1, 2)$$

(in the above-described section (3) "Feeding of Cleaning Water" (Automatic Cleaning of Processing Agent Kit)), $t_{3i}$ is recalculated by using the recalculated quantity of dilution water (the other numerical values are not altered).

In the next automatic cleaning of the processing kit, the development-processing-agent container cleaning valve (S740) 450, the bleach-processing-agent container cleaning valve (S741) 452, and the fixation-processing-agent container cleaning valve (S742) 454 are controlled on the basis of the new $t_{3i}$ (i=1, 2).

<Circulation and Agitation>

The suspension in the P1R replenishing tank 347 is dissolved and agitated.

This process is commenced upon completion of the automatic cleaning of P1R in the automatic cleaning of the processing agent kit.

The process ends when circulation and agitation have been effected for a predetermined time duration.

The sequence of operation is as follows:

The P1R circulating/agitating pump (PU745) 362 is driven for a time duration $t_4$ upon detection of the presence of solution by the upper limit level sensor (FS740) 358 in the P1R replenishing tank 347 after completion of the cleaning of P1R in the automatic cleaning of the processing agent kit.

<Operation>

Next, a description will be given of an example of replenishment operation.

First, it is assumed that the development replenishing solution, the bleaching replenishing solution, and the fixation replenishing solution are respectively stored in the P1R replenishing tank 347, the P2RA replenishing tank 349, and the P2RB replenishing tank 351 up to their upper limit levels or more, and that cleaning water is stored in advance in the PSR replenishing tank 426 up to its upper limit level or more.

If a predetermined quantity of photographic paper P is processed in the developing tank 74 of the processor section 72, the P1R replenishing pump (PU741) 370 is operated, and a P1R replenishment solenoid valve (S840) 378 is opened for a predetermined time, thereby allowing the development replenishing solution in a predetermined quantity corresponding to the quantity of the photographic paper P processed to be fed from the P1R replenishing tank 347 to the developing tank 74. Such processing is simultaneously effected in the bleaching tank 76 and the fixing tank 78 as well.

After a fixed quantity of processing has progressed, the notification of "LOAD PROCESSING AGENT KIT" is shown on the display unit 122.

Next, a description will be given of the procedure for loading the processing agent kit 202.

(1) First, the cover opening switch (D744) 315 is pressed. Consequently, the loading cover electromagnetic lock (S743) 308 is actuated, which in turn causes the leading end of the second lock lever 306 to be lifted upward, so that the leading end of the first lock lever 304 is not caught by the leading end of the second lock lever 306. Hence, the loading section cover 302 is set in a state in which it can be opened (unlocked state).

Then, the loading section cover 302 is pulled open forward. If the loading section cover 302 is opened, the cover opening/closing detecting switch (D740) 314 is turned off, and the controlling means 460 determines that the loading section cover 302 is in the open state.

(2) Next, if the loaded empty processing agent kit 202 is pushed once, the engagement between the striker 342 and the latch 344 is canceled, and the processing agent kit 202 is pushed out slightly.

Subsequently, if the empty processing agent kit 202 is taken out, the kit detecting lever 338 is rotated, and the kit detecting switch (D741) 340 is turned off, so that the controlling means 460 determines that the processing agent kit 202 is in the unloaded state.

(3) A new processing agent kit 202 is inserted in the holder 316.

If the processing agent kit 202 is inserted up to the normal position, the kit detecting lever 338 is rotated, which in turn causes the striker 342 and the latch 344 to engage with each other, and causes the kit detecting switch (D741) 340 to be turned on. Hence, the controlling means 460 determines that the processing agent kit 202 has been loaded.

Then, if the loading section cover 302 is closed, the cover opening/closing detecting switch (D740) 314 is turned on, so that the controlling means 460 determines that the loading section cover 302 has been closed.

(4) After processing has progressed, and the lower limit level sensor (FS745) 360 in the P1R replenishing tank 347 detects that there is no solution, timing adjustment is carried out, and the lower limit level sensor (FS746) 384 in the P2RA replenishing tank 349 and the lower limit level sensor (FS747) 406 in the P2RB replenishing tank 351 detect "no solution." Then, the seal-opening driving motor (M740) 328 is rotated until the loading-section lower limit detecting switch (D743) 336 is turned on, thereby allowing the holder 316 to be lowered to its lower limit position. Consequently, the cleaning nozzle 346, the cleaning nozzle 348, and the cleaning nozzle 350 respectively break open the seal 210 of the container 203, the seal 210 of the container 205, and the seal 210 of the container 207, and move into the containers to open the seals.

As a result, the P1R replenishing tank 347, the P2RA replenishing tank 349, and the P2RB replenishing tank 351 are respectively replenished automatically with the development processing agent, the bleach processing agent, and the fixation processing agent.

Upon completion of the outflow of the processing agents after the lapse of a predetermined time, the container cleaning pump (PU740) 440 is operated, and the development-processing-agent container cleaning valve (S740) 450, the bleach-processing-agent container cleaning valve (S741) 452, and the fixation-processing-agent container cleaning valve (S742) 454 are actuated. Consequently, cleaning water is jetted out from the cleaning nozzle 346, the cleaning nozzle 348, and the cleaning nozzle 350, so that the cleaning nozzle 346, the cleaning nozzle 348, and the cleaning nozzle 350 respectively automatically clean the interior of the container 203, the interior of the container 205, and the interior of the container 207 with predetermined quantities (refer to <Dilution Water Correction>) of cleaning water (dilution water), and the cleaning water flows into the respective replenishing tanks.

Further, upon completion of the automatic cleaning, the levels of the solutions in the respective replenishing tanks rise, and the upper limit level sensor (FS740) 358, the upper limit level sensor (FS741) 382, and the upper limit level sensor (FS742) 404 detect "solution present," so that (1) "management when there is solution present" described above is executed.

In addition, if the upper limit level sensor (FS740) 358 detects "solution present," the P1R circulating/ agitating pump (PU745) 362 is operated to circulate and agitate the development replenishing solution (development processing agent+cleaning water) in the P1R replenishing tank 347.

When the automatic cleaning is finished, the containers are allowed to dry naturally for a predetermined time duration with the holder 316 set in its lower limit position.

In the present embodiment, the above-described "management for reaching of lower limits for all replenishing tanks," "management when the lower limit tends to be reached earlier in the development replenishing tank," "management when the lower limits tend to be reached earlier in the other replenishing tanks," "processing replenishment, processing correction, and dilution water correction," and the like are executed, and the apparatus automatically revises the replenishment. Accordingly, it is unnecessary for the operator to effect various revision operations, and proper replenishment can be effected over extended periods of time.

Further, if a corrected value at the time of revision exceeds an allowable range, the notification of an abnormality is issued, thereby making it possible to ascertain that there is an abnormality in the apparatus.

It should be noted that if the residual volume of the development replenishing solution in the P1R replenishing tank 347 has not reached a predetermined value (lower limit level) or less when a preset quantity of paper has been processed, replenishment of the development replenishing solution may be forcibly effected to cause that residual volume to reach the predetermined value or less.

Furthermore, if the residual volume of the development replenishing solution in the P1R replenishing tank 347 has not reached a predetermined value or less when a preset quantity of paper has been processed, replenishment of the development replenishing solution may be forcibly effected to cause that residual volume to reach the predetermined value or less. Further, on the basis of the number or duration of replenishings until the predetermined value or less is reached, the replenishment quantity may be revised so that the residual quantity of the development replenishing solution reaches the predetermined value or less, and a notification may be given when the revised value exceeds the preset range.

Furthermore, if the residual volume of the development replenishing solution in the P1R replenishing tank 347 has reached a predetermined value (lower limit level) or less before a preset quantity of the photosensitive material has been processed, the replenishment of the development replenishing solution may be interrupted.

Furthermore, if the residual volume of the development replenishing solution in the P1R replenishing tank 347 has reached a predetermined value (lower limit level) or less before a preset quantity of paper has been processed, the replenishment quantity may be revised on the basis of the quantity of the paper processed until the level of the development replenishing solution reaches a predetermined value or less from the level at the time of replenishment, so that the development replenishing solution in the P1R replenishing tank 347 reaches a predetermined value or less when the preset quantity of paper processed is reached from the quantity of paper processed until the reaching of the predetermined value or less. Then, a notification may be given when the updated value exceeds the preset range.

It should be noted that, when replenishment is effected by the revised value, the replenishment interval (time duration) may be corrected based on the replenishment quantity.

It should be noted that since the discharge rate per unit time of the pump×the pump driving time=the quantity of solution fed by the pump, the controlling means 460 (in which the discharge rate per unit time of the pump is stored in advance) is able to indirectly determine the quantity of solution fed, on the basis of the pump driving time.

It should also be noted that although, in the above embodiment, the development replenishing solution corresponds to a specific replenishing solution in the present invention, the present invention is not limited to the same, and the specific replenishing solution may be another kind of replenishing solution such as a bleaching replenishing solution or a fixing replenishing solution.

When the respective replenishing tanks are replenished with predetermined quantities of processing agents from the processing agent kit 202, and the respective replenishing tanks are then reliably replenished with predetermined quantities of cleaning water, the levels of the solutions in the replenishing tanks should exceed the prescribed upper limit levels, and the volumes of the replenishing solutions above the upper limit levels in the replenishing tanks should provide the same quantity of processing of the photosensitive material.

However, the volumes of the replenishing solutions above the upper limit levels in the replenishing tanks fail to provide the same quantity of processing of the photosensitive material in the event of the malfunctioning of the cleaning-water replenishment system, i.e., fatigue of the container cleaning pump (PU740) 440, malfunctioning of the distributor 442, the development-processing-agent container cleaning valve (S740) 450, the bleach-processing-agent container cleaning valve (S741) 452, and the fixation-processing-agent container cleaning valve (S742) 454, and clogging or the like of the pipes 444, 446, and 448 and the cleaning nozzles 346, 348, and 350. Namely, if each replenishment is effected as prescribed, the number of replenishings should be equal to a predetermined number of times (e.g., $n_{3i}$).

Should some error (e.g., pump fatigue and the clogging of the pipes) occur in the cleaning-water replenishment system, the quantity of cleaning water (dilution water) which is actually replenished would be insufficient, the upper limit level would be reached even if the number of replenishings is less than the predetermined number of times (an actual number of replenishings ($n_{4i}$)≈a predetermined number of times ($n_{3i}$)), and the number of replenishings until the level of the solution drops to the lower limit level would also change.

In the present embodiment, in an event that a situation occurs where the actual number of replenishings ($n_{4i}$)≈a predetermined number of times ($n_{3i}$), the controlling means 460 calculates the volume of the replenishing solution above the upper limit level after replenishment of cleaning water on the basis of the number of replenishings until the level of the solution drops to the upper limit level in the replenishing tank from the level persisting after replenishment. The controlling means 460 then compares the calculated volume with the volume of the replenishing solution when replenishment is effected a predetermined number of times, and changes the driving time duration of the container cleaning pump (PU740) 440 to correspond with that ratio. For example, if there is a shortage in the discharge rate per unit time of the pump, the clogging of the pipe, or the like, even if the container cleaning pump (PU740) 440 is driven for the same time duration, the actual quantity of replenishing solution replenished is insufficient. In such a case, therefore, the operation time of the container cleaning pump (PU740) 440 during replenishment of cleaning water is prolonged to correspond with the aforementioned ratio, thereby making it possible to cause the actual number of replenishings to agree with the predetermined number of times.

In addition, if the quantity of dilution water ($Q_{ci}$) and the values of each correction are compared, and the result exceeds the range shown in Table 6 referred to earlier, it is considered that an allowable range of error has been exceeded, i.e., a malfunctioning has occurred, so that the notification of an abnormality is made.

Another Embodiment

Next, a description will be given of another embodiment which makes it possible to reliably prevent the spilling or dripping of the processing agents at the time when the processing agent kit 202 is installed or removed.

It should be noted that, in this embodiment, in the operation of the loading section 300, there are portions which differ from the above-described embodiment with respect to (1) "the loading of the processing agent kit," (4) "the maintaining of the seal-opened state," and (5) "the withdrawal of the loading section." Hereafter, a description will be given of (1) "the loading of the processing agent kit," (4) "the maintaining of the seal-opened state," and (5) "the withdrawal of the loading section" in accordance with this embodiment.

(1) "Loading of Processing Agent Kit" (Management of Processing Agent Kit)

When the processing agent kit 202 is not loaded, or the processing agent kit 202 in the loaded state has been used up and drying has been completed, the loading section cover 302 is made openable to prompt the loading of a new processing agent kit 202 in the loading section 300.

This process is commenced under the following condition:

After the loading section cover 302, which was open, is closed.

In addition, the process ends under the following condition:

When the loading section cover 302 is opened.

The sequence of operation is as follows:

The loading section cover 302 is made capable of being unlocked under any one of the following conditions. (The loading section cover 302 is set in such a state that the loading cover electromagnetic lock (S743) 308 can be turned on when the cover opening switch (D744) 315 is pressed (turned on)).

(a) If the loading section 300 in which the processing agent kit 202 with unopened seals is loaded is at the upper limit.

(b) Upon completion of the drying of the containers 203, 205, and 207 which have been cleaned (which will be described later).

(c) The processing agent kit 202 is not detected when the loading section cover 302 is closed.

In the aforementioned items of operation, the following are notified:

(i) Notification of "LOAD PROCESSING AGENT KIT." (For items (b) and (c) above)

(ii) Notification of "CLOSE LOADING SECTION COVER." The status of detection of the loading of the kit is "undetected→detected," and "detected→undetected→detected," and the cover opening/closing detecting switch (D740) 314 is off (the loading section cover 302 is open).

(iii) Notification of "LOADING SECTION COVER IS OPENABLE." (For items (b) and (c) above)

(4) and (5) "Maintaining of Seal-Opened State" and "Withdrawal of Loading Section" (Drying of Processing Agent Kit)

The containers 203, 205, and 207 are maintained in open states, and are allowed to dry naturally. This process is commenced upon completion of the cleaning of the containers 203, 205, and 207.

This process ends under the following condition:

When a predetermined time duration has lapsed.

The process ends after the loading section is temporarily stopped at its lower limit position for a predetermined time (variable) subsequent to cleaning, and the containers 203, 205, and 207 are allowed to dry naturally, and after the holder 316 of the loading section 300 is returned to its upper limit position.

In the above operation, the following is notified:

The notification of "COVER IS OPENABLE." (For item (A) above)

Figure 12:
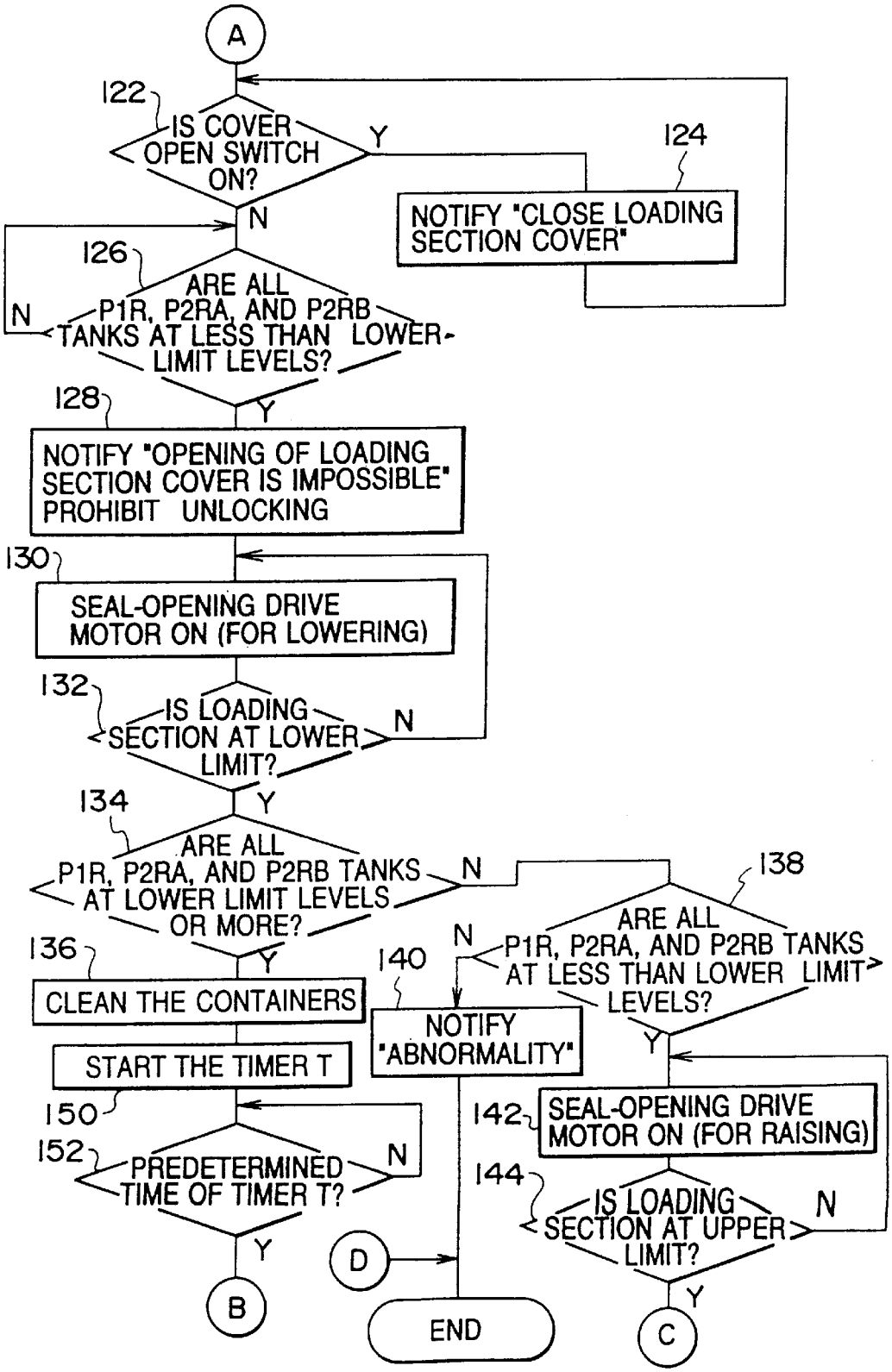
FIG. 12 is a continuation of the flowchart of FIG. 11.
Figure 13:
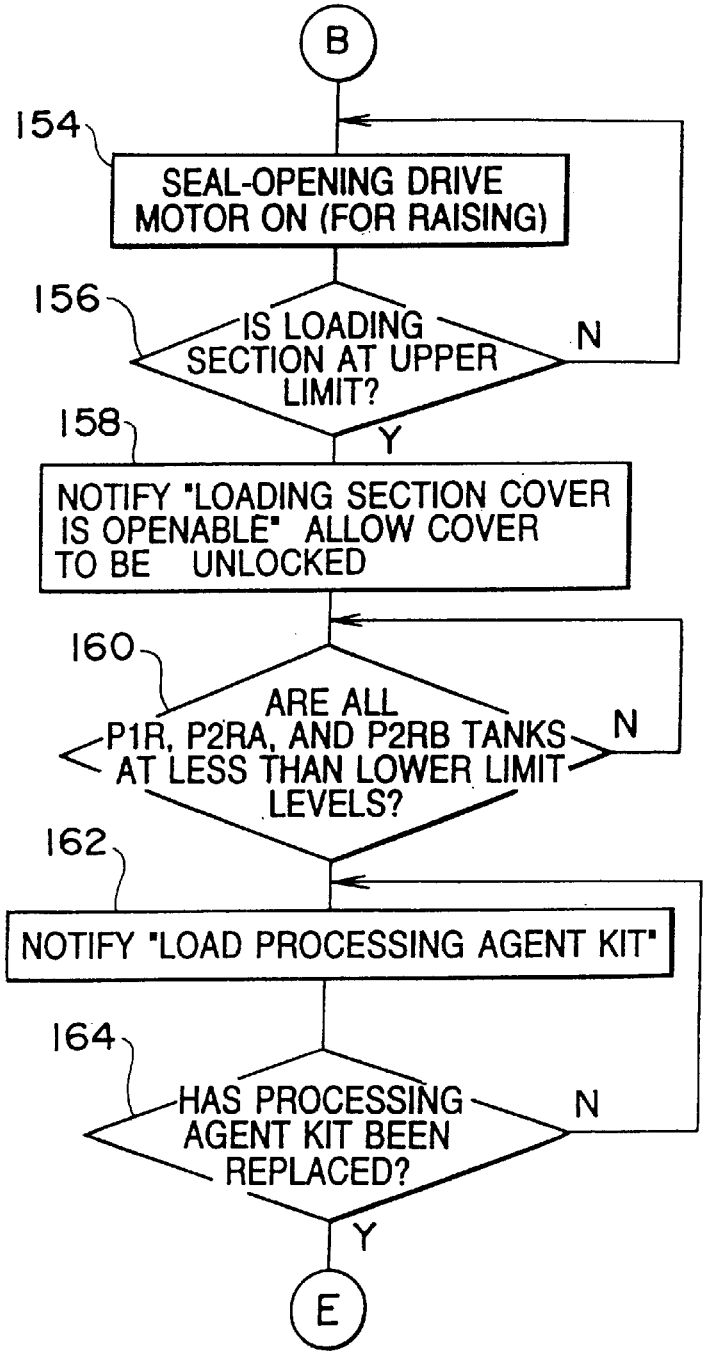
FIG. 13 is a continuation of the flowchart of FIG. 12.

Referring now to the flowcharts shown in FIGS. 11 to 13, a description will be given of an example (the essential portions) of control in accordance with this embodiment.

Figure 11:
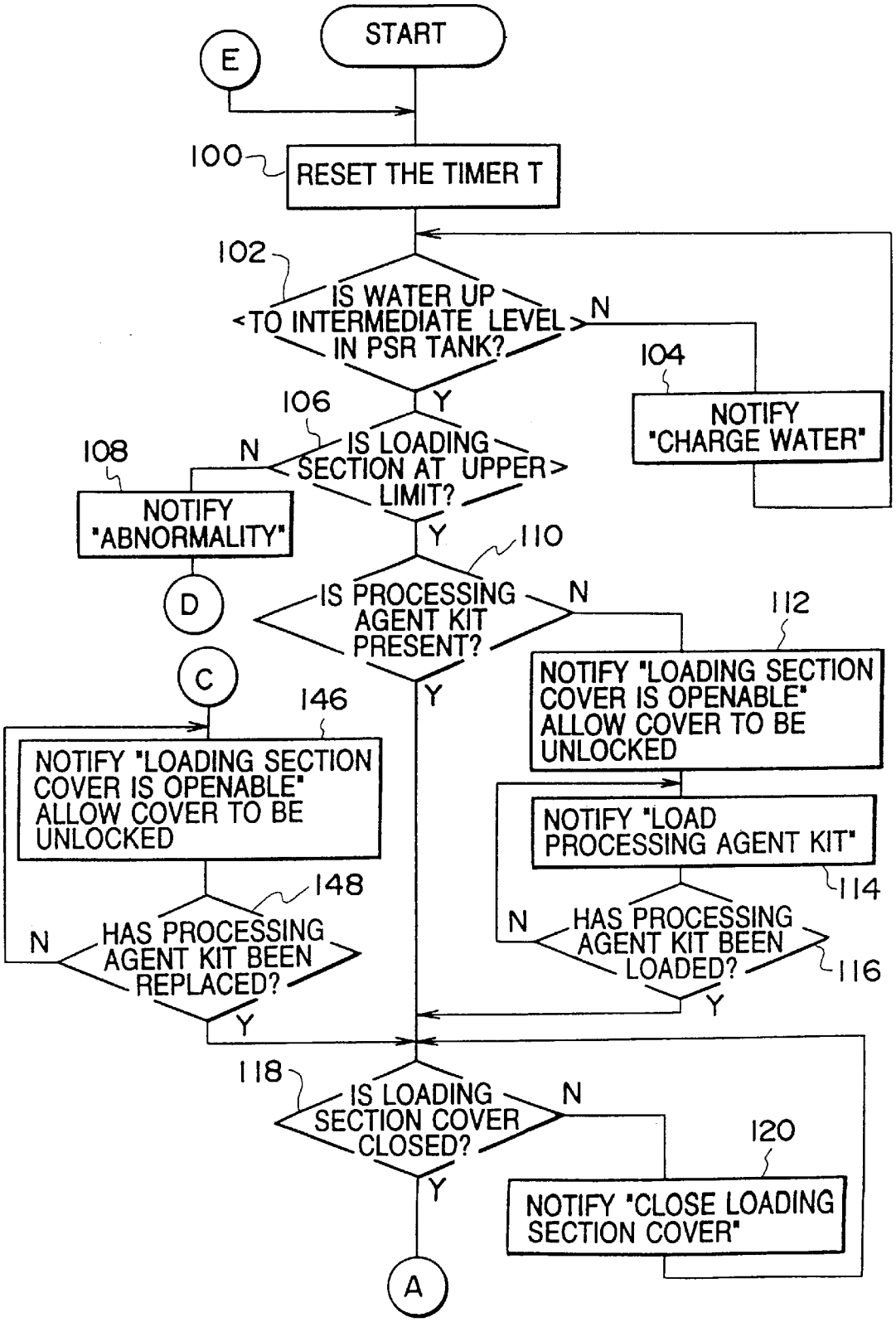
FIG. 11 is a flowchart illustrating control in accordance with the present embodiment.

As shown in the flowchart in FIG. 11, in Step 100, a timer T is reset.

In the ensuing Step 102, a determination is made as to whether or not there is cleaning water as high as the intermediate level in the PSR replenishing tank 426. If the cleaning water is lower than the intermediate level, the operation proceeds to Step 104 in which a notification of "SUPPLY WATER" is made on the display unit 122. If cleaning water is at the intermediate level or more, the operation proceeds to Step 106.

In Step 106, a determination is made as to whether or not the loading section 300 is at its upper limit. If it is not at the upper limit, the operation proceeds to Step 108 in which a notification of "ABNORMALITY" is made on the display unit 122, and processing ends. If the loading section 300 is at the upper limit, the operation proceeds to Step 110.

In Step 110, a determination is made as to the presence or absence of the processing agent kit 202. If the processing agent kit 202 is absent, the operation proceeds to Step 112 in which a notification of "LOADING SECTION COVER IS OPENABLE" is given on the display unit 122, and the loading section cover 302 is set in a state in which it can be unlocked (in the state in which the loading cover electromagnetic lock (S743) 308 is operable when the cover opening switch (D744) 315 is pressed). On the other hand, if the processing agent kit 202 is present, the operation proceeds to Step 118.

In Step 114, a notification of "LOAD PROCESSING AGENT KIT" is given on the display unit 122.

In the ensuing Step 116, a determination is made as to whether or not the processing agent kit 202 has been loaded. If it has been loaded, the operation proceeds to Step 118, and if not, the operation returns to Step 114.

In Step 118, a determination is made as to whether or not the loading section cover 302 has been closed. If it is determined that the loading section cover 302 has not been closed, the operation proceeds to Step 120 in which a notification of "CLOSE LOADING SECTION COVER" is given on the display unit 122. If it is determined that the loading section cover 302 has been closed, the operation proceeds to Step 122 in FIG. 12.

In Step 122, a determination is made as to whether or not the cover opening switch (D744) 315 has been pressed (turned on). If it has been turned on, the operation proceeds to Step 124 in which a notification of "CLOSE LOADING SECTION COVER" is given on the display unit 122. If the cover opening switch (D744) 315 is off, the operation proceeds to Step 126.

In Step 126, a determination is made as to whether or not solutions in the P1R replenishing tank 347, the P2RA replenishing tank 349, and the P2RB replenishing tank 351 are at less than their lower limit levels. If the solutions in all the tanks have reached less than the lower limit levels, the operation proceeds to the ensuing Step 128.

In Step 128, a notification of "OPENING OF LOADING SECTION COVER IS IMPOSSIBLE" is given on the display unit 122, and the loading section cover 302 is set in a state in which its unlocking is prohibited (in the state in which the loading cover electromagnetic lock (S743) 308 is not operable when the cover opening switch (D744) 315 is pressed).

In Step 130, the seal-opening driving motor (M740) 328 is operated to lower the loading section 300.

In Step 132, a determination is made as to whether or not the loading section 300 has reached its lower limit, and if it has reached the lower limit, the operation proceeds to the ensuing Step 134.

When the loading section 300 is lowered, the cleaning nozzle 346, the cleaning nozzle 348, and the cleaning nozzle 350 respectively break open the seal 210 of the container 203, the seal 210 of the container 205, and the seal 210 of the container 207, and advance into the containers to effect the seal opening. As a result, the P1R replenishing tank 347, the P2RA replenishing tank 349, and the P2RB replenishing tank 351 are respectively replenished automatically with the development processing agent, the bleach processing agent, and the fixation processing agent.

In Step 134, a determination is made as to whether or not solutions in the P1R replenishing tank 347, the P2RA replenishing tank 349, and the P2RB replenishing tank 351 have reached their lower limit levels or more. If they have reached their lower limit levels or more, the operation proceeds to Step 136, whereas if they have not, the operation proceeds to Step 138.

In Step 138, a determination is made as to whether or not solutions in the P1R replenishing tank 347, the P2RA replenishing tank 349, and the P2RB replenishing tank 351 are at less than their lower limit levels. If the solutions in all the tanks are not at less than the lower limit levels, the operation proceeds to Step 140 to give a notification of "ABNORMALITY" on the display unit 122, and the processing ends.

On the other hand, if the solutions in all the tanks are at less than the lower limit levels, the operation proceeds to Step 142 in which the seal-opening driving motor (M740) 328 is operated to raise the loading section 300.

In Step 144, a determination is made as to whether or not the loading section 300 has reached its upper limit, and if it has reached the upper limit, the operation proceeds to Step 146 in FIG. 11.

In Step 146, a notification of "LOADING SECTION COVER IS OPENABLE" is given on the display unit 122, and the loading section cover 302 is set in a state in which it can be unlocked. Subsequently, "RESET" is displayed.

In Step 148, a determination is made as to whether or not the processing agent kit 202 has been replaced, and if the processing agent kit 202 has been replaced, the operation proceeds to Step 118.

On the other hand, in Sep 136, the container cleaning pump (PU740) 440 is operated, and the development-processing-agent container cleaning valve (S740) 450, the bleach-processing-agent container cleaning valve (S741) 452, and the fixation-processing-agent container cleaning valve (S742) 454 are actuated. Consequently, cleaning water is jetted out from the cleaning nozzle 346, the cleaning nozzle 348, and the cleaning nozzle 350, so that the cleaning nozzle 346, the cleaning nozzle 348, and the cleaning nozzle 350 respectively automatically clean the interior of the container 203, the interior of the container 205, and the interior of the container 207 with predetermined quantities (refer to <Dilution Water Correction>) of cleaning water (dilution water), and the cleaning water flows into the respective replenishing tanks.

Further, solution levels in the respective replenishing tanks rise, and the upper limit level sensor (FS740) 358, the upper limit level sensor (FS741) 382, and the upper limit level sensor (FS742) 404 detect "solution present," so that (1) "management when there is solution present" described above is executed. In addition, if the upper limit level sensor (FS740) 358 detects "solution present," the P1R circulating/agitating pump (PU745) 362 is operated to effect the circulation and agitation of the development replenishing solution (development processing agent+cleaning water) in the P1R replenishing tank 347 (for details, refer to <Circulation and Agitation>.

When cleaning is finished, the operation proceeds to Step 150 to start the timer T. When the automatic cleaning is finished, the natural drying of the containers for a predetermined time duration is started with the holder 316 set in its lower limit position (for details, refer to (4) and (5) "Maintaining of Seal-Opened State" and "Withdrawal of Loading Section" (Drying of Processing Agent Kit)).

In Step 152, a determination is made as to whether or not the predetermined time ($t_{51}$–$t_{52}$) of the timer T has elapsed (i.e., whether or not the drying of the containers has been finished). If the predetermined time has elapsed, the operation proceeds to Step 154 in FIG. 13.

In Step 154, the seal-opening driving motor (M740) 328 is operated to raise the loading section 300. If it is determined in Step 156that the loading section 300 has reached its upper limit, the operation proceeds to Step 158.

In Step 158, a notification of "LOADING SECTION COVER IS OPENABLE" is given on the display unit 122, and the loading section cover 302 is set in a state in which it can be unlocked.

In this embodiment, during the period from the beginning of the replenishment of the processing agents, through the cleaning of the containers, and until the end of the drying of the containers, the loading cover electromagnetic lock (S743) 308 is not operable even if the cover opening switch (D744) 315 is pressed, so that the processing agent kit 202 cannot be taken out. Hence, it is possible to prevent the dripping of the replenishing solutions and cleaning water.

In Step 160, a determination is made as to whether or not solutions in the P1R replenishing tank 347, the P2RA replenishing tank 349, and the P2RB replenishing tank 351 are at less than their lower limit levels. If the solutions in all the tanks have reached less than the lower limit levels, the operation proceeds to Step 162 to notify "LOAD PROCESSING AGENT KIT" on the display unit 122.

In Step 164, a determination is made as to whether or not the processing agent kit 202 has been replaced, and if the processing agent kit 202 has been replaced, the operation returns to Step 100 in FIG. 11 to repeat the processing.

Figure 14:
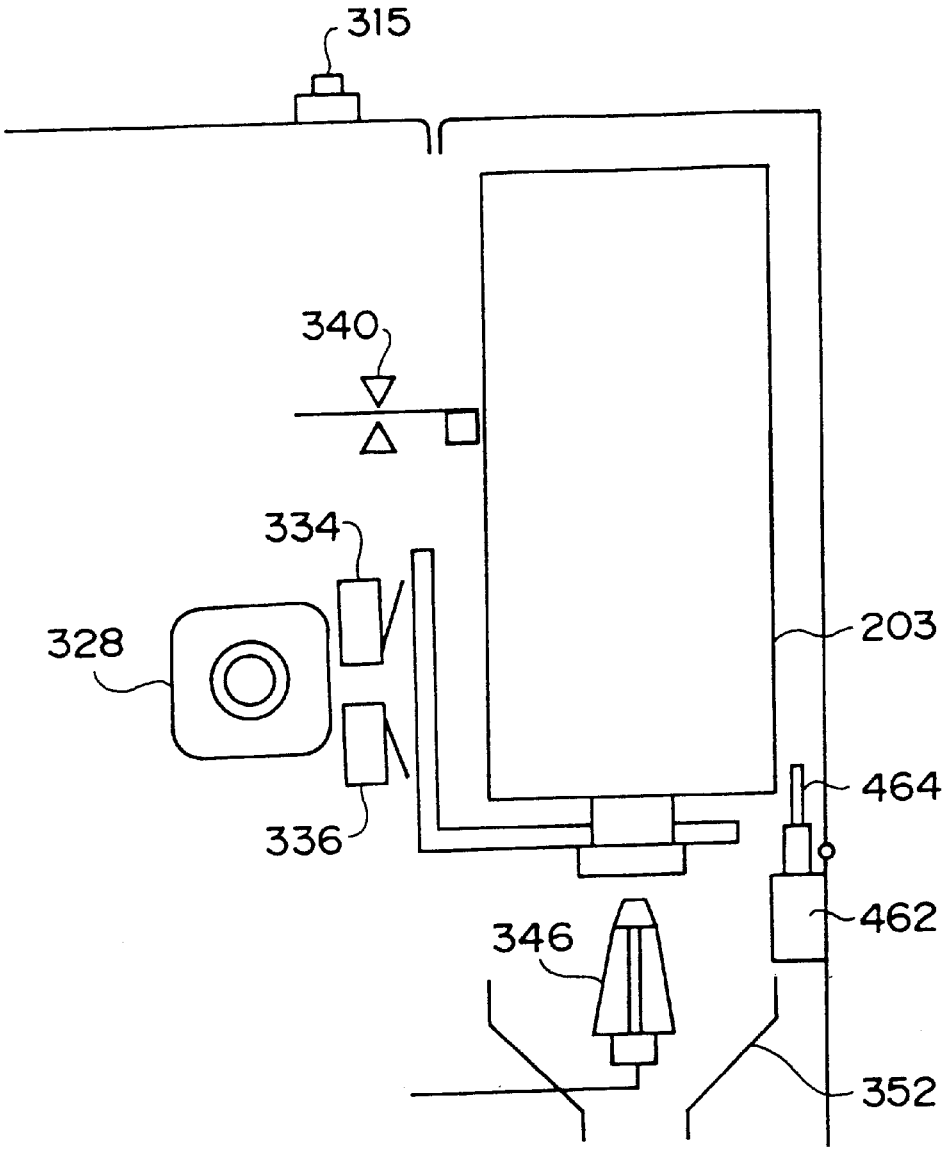
FIG. 14 is a structural diagram of another embodiment of the present invention.

Although, in this embodiment, in order to prevent the dripping of the replenishing solutions and cleaning water during the replacement of the processing agent kit 202, the loading section cover 302 is arranged to be unopenable even if the cover opening/closing detecting switch (D740) 314 is pressed, a system may be adopted wherein, as shown in FIG. 14, a lever 464 which is driven by a solenoid 462 or the like is provided at an inlet/outlet port for the processing agent kit 202, and the processing agent kit 202 is pressed by the lever 464 so that the processing agent kit 202 cannot be taken out during the period from the beginning of the replenishment of the processing agents, through the cleaning of the containers, and until the end of the drying of the containers.

What is claimed is:

1. A photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply said plurality of replenishing tanks with the plurality of types of replenishing agents, comprising:

an upper limit sensor provided in each of said replenishing tanks capable of detecting whether the levels of the surfaces of the replenishing solutions have exceeded a predetermined upper limit level;

replenishing means for replenishing said processing tanks with the replenishing solutions in said replenishing tanks;

a dilution water tank for storing the dilution water;

dilution-water supplying means for supplying said replenishing tanks with the dilution water; and controlling means for controlling said dilution-water supplying means, wherein the controlling means revises the subsequent quantities of dilution water supplied on the basis of the quantities of replenishing solution replenished to the processing tanks between the time the replenishing agents and the fixed quantities of diluted water were supplied to the replenishing tanks until the levels of the solutions drop to the upper limit level.

2. The photosensitive-material processing-solution replenishing apparatus according to claim 1, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

3. A photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply said plurality of replenishing tanks with the plurality of types of replenishing agents from a processing agent kit loaded in said apparatus by opening the seals of said processing agent kit, comprising:

replenishing means for replenishing said processing tanks with the replenishing solutions in said replenishing tanks;

a dilution water tank for storing the dilution water;

dilution-water supplying means for supplying said replenishing tanks with the dilution water;

replenishing-agent supply detecting means having a lower limit sensor capable of detecting whether the levels of the surfaces of the replenishing solutions have exceeded a predetermined lower limit level, and once the levels of the surface of the solution have reached the lower limit levels or less, the seals of the processing agent kit are opened and the detecting means then detects that the supply of the replenishing agent has been completed when the levels of the surfaces of the solutions have risen above the lower limit levels; and dilution-water supply detecting means having an upper limit sensor capable of detecting whether the levels of the surfaces of the replenishing solutions have exceeded a predetermined upper limit level, and once the dilution water supply detecting means has detected that the supply of the replenishing agents has been completed, dilution water is supplied, and once the levels of the surfaces of the solutions have risen above the upper limit level, the dilution water supply detecting means detects that the supply of the dilution water has been completed.

4. The photosensitive-material processing-solution replenishing apparatus according to claim 2, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

5. A photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply said plurality of replenishing tanks with the plurality of types of replenishing agents from a processing agent kit loaded in said apparatus by opening the seals of said processing agent kit, comprising:

replenishing means for replenishing said processing tanks with the replenishing solutions in said replenishing tanks;

a dilution water tank for storing the dilution water;

dilution-water supplying means for supplying said replenishing tanks with the dilution water; and replenishing-agent supply detecting means having a lower limit sensor capable of detecting whether the levels of the surfaces of the replenishing solutions have exceeded a predetermined lower limit level, and once the levels of the surface of the solution have reached the lower limit levels or less, the seals of the processing agent kit are opened and the detecting means then detects that the supply of the replenishing agent has been completed when the levels of the surfaces of the solutions have risen above the lower limit levels.

6. The photosensitive-material processing-solution replenishing apparatus according to claim 5, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

7. A photosensitive-material processing-solution replenishing apparatus having a plurality of replenishing tanks for storing a plurality of types of replenishing solutions in which replenishing agents in concentrated form are diluted with dilution water, so as to replenish photosensitive-material processing tanks with the replenishing solutions in accordance with a quantity processed of a photosensitive material and collectively supply said plurality of replenishing tanks with the plurality of types of replenishing agents from a processing agent kit loaded in said apparatus by opening the seals of said processing agent kit, comprising:

replenishing means for replenishing said processing tanks with the replenishing solutions in said replenishing tanks;

a dilution water tank for storing the dilution water;

dilution-water supplying means for supplying said replenishing tanks with the dilution water; and dilution-water supply detecting means having an upper limit sensor capable of detecting whether the levels of the surfaces of the replenishing solutions have exceeded a predetermined upper limit level, and once the dilution water supply detecting means has detected that the supply of the replenishing agents has been completed, dilution water is supplied, and once the levels of the surfaces of the solutions have risen above the upper limit level, the dilution water supply detecting means detects that the supply of the dilution water has been completed.

8. The photosensitive-material processing-solution replenishing apparatus according to claim 7, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

9. A photosensitive-material processing-solution replenishing apparatus for collectively supplying a plurality of replenishing tanks with a plurality of types of replenishing solutions, comprising:

photosensitive-material processing-quantity detecting means for detecting a quantity processed of a photosensitive material;

said plurality of replenishing tanks provided to correspond with a plurality of processing tanks for processing the photosensitive material in processing solutions, and for storing the plurality of types of replenishing solutions;

replenishing solution-quantity detecting means provided in each of said replenishing tanks for detecting whether the residual quantity of the replenishing solution is at a predetermined value or less;

replenishing means for replenishing said processing tanks with the replenishing solutions in said replenishing tanks; and controlling means for controlling said replenishing means so that said processing tanks are replenished with the replenishing solutions in a quantity corresponding to a predetermined quantity processed of the photosensitive material, wherein, if the residual quantity of a specific replenishing solution has not reached the predetermined value or less when a preset quantity of the photosensitive material has been processed, said controlling means forcibly causes the replenishment to be effected so that the residual quantity of the specific replenishing solution reaches the predetermined value or less.

10. The photosensitive-material processing-solution replenishing apparatus according to claim 9, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

11. A photosensitive-material processing-solution replenishing apparatus for collectively supplying a plurality of replenishing tanks with a plurality of types of replenishing solutions, comprising:

photosensitive-material processing-quantity detecting means for detecting a quantity processed of a photosensitive material;

said plurality of replenishing tanks provided to correspond with a plurality of processing tanks for processing the photosensitive material in processing solutions, and for storing the plurality of types of replenishing solutions;

replenishing solution-quantity detecting means provided in each of said replenishing tanks to detect whether the residual quantity of the replenishing solution is at a predetermined value or less;

replenishing means for replenishing said processing tanks with the replenishing solutions in said replenishing tanks;

controlling means for controlling said replenishing means so as to replenish said processing tanks with the replenishing solutions in a quantity corresponding to a predetermined quantity processed of the photosensitive material; and warning means which is controlled by said controlling means, wherein, if the residual quantity of a specific replenishing solution has not reached the predetermined value or less when a preset quantity of the photosensitive material has been processed, said controlling means forcibly causes the replenishment to be effected so that the residual quantity of the specific replenishing solution reaches the predetermined value or less, said controlling means calibrates a replenishment quantity on the basis of the duration or number of replenishings until the predetermined value or less is reached, so that the residual quantity of the specific replenishing solution reaches the predetermined value or less when the preset quantity of the photosensitive material has been processed, and said controlling means causes said warning means to issue a warning if the calibrated value is outside a preset range.

12. The photosensitive-material processing-solution replenishing apparatus according to claim 11, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

13. A photosensitive-material processing-solution replenishing apparatus for collectively supplying a plurality of replenishing tanks with a plurality of types of replenishing solutions, comprising:

photosensitive-material processing-quantity detecting means for detecting a quantity processed of a photosensitive material;

said plurality of replenishing tanks provided to correspond with a plurality of processing tanks for processing the photosensitive material with processing solutions, and for storing the plurality of types of replenishing solutions;

replenishing solution-quantity detecting means provided in each of said replenishing tanks to detect whether the residual quantity of the replenishing solution is at a predetermined value or less;

replenishing means for replenishing said processing tanks with the replenishing solutions in said replenishing tanks; and controlling means for controlling said replenishing means so as to replenish said processing tanks with the replenishing solutions in a quantity corresponding to a predetermined quantity processed of the photosensitive material, wherein, if the residual quantity of a specific replenishing solution has reached the predetermined value or less before a preset quantity of the photosensitive material has been processed, said controlling means interrupts the replenishment from the specific replenishing solution until the preset quantity of the photosensitive material has been processed.

14. The photosensitive-material processing-solution replenishing apparatus according to claim 13, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

15. A photosensitive-material processing-solution replenishing apparatus for collectively supplying a plurality of replenishing tanks with a plurality of types of replenishing solutions, comprising:

photosensitive-material processing-quantity detecting means for detecting a quantity processed of a photosensitive material;

said plurality of replenishing tanks provided to correspond with a plurality of processing tanks for processing the photosensitive material with processing solutions, and for storing the plurality of types of replenishing solutions;

replenishing solution-quantity detecting means provided in each of said replenishing tanks to detect whether the residual quantity of the replenishing solution is at a predetermined value or less;

replenishing means for replenishing said processing tanks with the replenishing solutions in said replenishing tanks to correspond with a predetermined quantity of processed photosensitive material;

controlling means for controlling said replenishing means so as to replenish said processing tanks with the replenishing solutions in a quantity corresponding to the predetermined quantity processed of the photosensitive material; and warning means which is controlled by said controlling means, wherein, if the residual quantity of a specific replenishing solution has reached the predetermined value or less before a preset quantity of the photosensitive material has been processed, the controlling means calculates the quantity of replenishment on the basis of the quantity of photosensitive material processed between the point when the solution was replenished until the point when the level of the solution reached the preset value or less, so that on the basis of the quantity of photosensitive material processed before the level of the replenishing solution reaches the preset value or less, the specific replenishing solution reaches the preset value or less at the time when the predetermined quantity of photosensitive material has been processed, and said controlling means causes said warning means to issue a warning if the calibrated value is outside a preset range.

16. The photosensitive-material processing-solution replenishing apparatus according to claim 15, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

17. A photosensitive-material processing-solution replenishing apparatus for collectively supplying a plurality of replenishing tanks with a plurality of types of replenishing solutions, comprising:

photosensitive-material processing-quantity detecting means for detecting a quantity processed of a photosensitive material;

said plurality of replenishing tanks provided to correspond with a plurality of processing tanks for processing the photosensitive material with processing solutions, and for storing the plurality of types of replenishing solutions;

replenishing solution-quantity detecting means provided in each of said replenishing tanks to detect whether the residual quantity of the replenishing solution is at a predetermined value or less;

replenishing means for replenishing said processing tanks with the replenishing solutions in said replenishing tanks; and controlling means for controlling said replenishing means so as to replenish said processing tanks with the replenishing solutions in a quantity corresponding to a predetermined quantity processed of the photosensitive material, wherein, if the residual quantities of the other replenishing solutions are greater than the predetermined value when the residual quantity of a specific replenishing solution has reached the predetermined value or less, said controlling means effects any one of or an arbitrary combination of two or more of the following four processes:

(i) a process whereby the replenishment from the other replenishing solutions is effected forcibly until the residual quantities of the other replenishing solutions reach the predetermined value or less;

(ii) a process whereby the replenishment from the specific replenishing solution is interrupted until the residual quantities of the other replenishing solutions reach the predetermined value;

(iii) a process whereby the replenishment from the other replenishing solutions is effected forcibly until the residual quantities of the other replenishing solutions reach the predetermined value or less, and for revising the quantities replenished from the other replenishing solutions per unit quantity processed of the photosensitive material on the basis of the time required for the forcible replenishment or the number of the forcible replenishments; and (iv) a process whereby the replenishment from the other replenishing solutions is effected forcibly until the residual quantities of the other replenishing solutions reach the predetermined value or less, and for revising the quantity replenished from the specific replenishing solution per unit quantity processed of the photosensitive material on the basis of the time required for the forcible replenishment or the number of the forcible replenishments.

18. The photosensitive-material processing-solution replenishing apparatus according to claim 17, further comprising:

a loading section for loading containers containing the replenishing agents; and at least one of warning means for issuing a warning prohibiting the movement of said containers during the replenishment of the replenishing agents or until the lapse of a predetermined time after the completion of the replenishment, and movement prohibiting means for prohibiting the movement of said containers during the replenishment of the replenishing agents or until the lapse of a predetermined time after the completion of the replenishment.

19. A photosensitive-material processing-solution replenishing apparatus having a replenishing tank for storing a replenishing agent with which a processing tank for processing a photosensitive material with a processing solution is replenished, wherein the replenishing agent contained in a container loaded into said apparatus is allowed to flow out by opening a seal of the container, thereby supplying said replenishing tank with the replenishing agent, comprising:

a loading section for loading said container; and at least one of warning means for issuing a warning prohibiting the movement of said container during the replenishment of the replenishing agent or until the lapse of a predetermined time after the completion of the replenishment, and movement prohibiting means for prohibiting the movement of said container during the replenishment of the replenishing agent or until the lapse of a predetermined time after the completion of the replenishment.

20. The photosensitive-material processing-solution replenishing apparatus according to claim 19, wherein said movement prohibiting means has a pressing member for pressing said container.

21. The photosensitive-material processing-solution replenishing apparatus according to claim 19, wherein said movement prohibiting means has a cover for covering said container.

* * * * *